United States Patent [19]

Yang

[11] Patent Number: 4,632,375

[45] Date of Patent: Dec. 30, 1986

[54] SERVO-CLAMPING DEVICE

[76] Inventor: Tai-Her Yang, 5-1 Tay Pyng St., Shi Hwu Jenn, Jang Huah Shiann, Taiwan

[21] Appl. No.: 564,319

[22] Filed: Dec. 22, 1983

[51] Int. Cl.[4] ..... B25B 1/24

[52] U.S. Cl. ..... 269/262; 269/258; 269/265

[58] Field of Search ..... 269/156, 257–259, 269/261, 268–271, 279, 280, 283

[56] References Cited

U.S. PATENT DOCUMENTS

| | | | |
|---|---|---|---|
| 1,249,207 | 12/1917 | Ruff | 269/268 X |
| 2,541,605 | 2/1951 | Ohlsson | 269/156 X |
| 2,724,269 | 11/1955 | Parrish et al. | 269/268 X |
| 4,291,870 | 9/1981 | Warde | 269/279 |

*Primary Examiner*—Frederick R. Schmidt
*Assistant Examiner*—Steven P. Schad
*Attorney, Agent, or Firm*—Leonard Bloom

[57] ABSTRACT

A clamping device of the type having a pair of clamping jaws mounted on a base, wherein one of said jaws is laterally movable in a direction towards and away from the other jaw, and wherein the other jaw includes a pair of movable clamping jaws arranged laterally of one another. Each movable jaw is multi-layered and includes a pair of movable, pivotable clamping claws spaced vertically of one another. Said clamping claws are each provided with forward multi-faceted portions including at least a pair of planar clamping faces arranged transversely of one another. A non-movable supporting ring member is interposed between the pair of clamping claws. This support member has a forward portion extending substantially inwardly of the multi-faceted planar faces of the respective movable clamping claws. The support member further has a rearward portion provided with a flat edge for bearing against an upwardly-extending base member.

3 Claims, 102 Drawing Figures

SERVO-CLAMPING DEVICE

DISCLOSURE OF THE INVENTION

A servo-clamping device, especially the device which rotates in a fixed position by means of the movable clamping claws or rotates on the clamping jaw group or on the auxiliary block of the clamping jaw in single step or multi-step or lammates formation, whereas the movable clamping claw can have a rotary back in a form of arc, while its clamping end can be in a form of plane, concave face, convex face, arc, tooth shape, or any other geometric shape as appropriate; its clamping jaw group consists of one or more groups of fixed jaws and movable jaws groups with the two sides or multiple sides of such jaws in a single step or multiple step form; the clamping side of each of the clamping jaws may have sideway driving slide seat which can be in a perpendicular straight line or oblique straight line or concave or convex arc-shaped keyway structure to serve as a sideway adjustment of the displacement, or may have a slide seat concurrently with an appropriate angular rotary back and sideway driving structure. By means of the ball socket seat on its back and the dunnage black of the ring-shaped post in the bottom or ball joint, the driving jaw part of the above-cited clamping jaw group can make the driving jaw through the guide screw drive the servo into rotary rotations or just partial rotation to an appropriate angle. As to the clamping device in conjunction with this design, its clamping jaw group can be directly and firmly fixed on the base seat structure of the body same to that of the clamping device, or can be selectively plugged into base seat structure with multi-step adjustment positions, whereas this base seat can be in a form that its one side is fixed, and its another side can be driven by a guide screw, and this base seat can have support walls or be directly provided with a several groups of equal-distant positioning holes to accommodate the clamping jaw groups or movable clamping claws in firmly fixed positions.

On the base seat or fixed jaw of the above-cited servo-clamping device, an auxiliary blocking block structure can be provided. This auxiliary blocking block structure which is positioned on one side or two sides of the clamping jaw or base seat can also be provided in another form of small-sized blocking block to be driven by manual force or electric power sideways.

DEATILED DESCRIPTION OF THE INVENTION

This invention provides a servo-clamping device which, by means of the multi-directional rotary and suspended swinging movable clamping claw, is positioned in the clamping jaw groups, whereas the clamping jaw groups can be driven on one direction or adjusted in sideway displacements, or adjusted in angular displacements or in suspended swinging or in small angular rotations, or are set separately in a multi-direction form. Therefore, this design can be installed on the common processing work benches, and machine tools, and firmly fixed on the work benches on the floor so as to easily lock up the servos in proper directions, positions and angles in response to work pieces in various shapes and positions as its feature.

FIG. 19 shows the top view of the multi-functional movable clamping claw in conjunction with the present invention.

FIG. 20 shows the A—A cross-sectional view of the multi-functional movable clamping claw in conjunction with the present invention.

FIG. 21 shows the B—B cross-sectional view of the multi-functional movable clamping claw in conjunction with the prefunctional movable clamping claw in conjunction with the present invention.

FIG. 22 shows the three-dimensional view of the multi-functional movable claw in conjunction with the present invention.

FIG. 44 shows the three-dimensional view of the open-type arc positioning seat of the clamping jaw group which positions the clamping claws in conjunction with the present invention.

FIG. 83-1 shows the inwardly inclining connection holes on the positioning seat and the positioning slide seat of the work-table (bench)-style base seat in conjunction with the present invention.

FIG. 83-2 shows the branch-type fork connection holes on the positioning seat or positioning slide seat of the work-table(bench)-style base seat in conjunction with the present invention.

FIG. 83-3 shows the wave-shaped or pinacle-shaped connection holes on the positioning seat or positioning slide seat of the work-table (bench)-type base seat in conjunction with the present invention.

FIG. 83-4 shows the three-dimensional view of the movable clamping claws which can be inserted and fixed in the positioning seat or positioning slide seat in conjunction with the present invention.

FIG. 83-5 shows the top view of the clamping side of the plane and the eccentric arc face of the movable clamping claw in conjunction with the present invention.

FIG. 83-6 shows the top view of the clamping side of the plane and the eccentric arc face of the movable clamping claw in conjunction with the present invention.

FIG. 83-7 shows the three-dimensional view of the clamping side and the push handle of the plane and the eccentric arc face of the movable clamping claws in conjunction with the present invention.

FIG. 83-8 shows the view of the clamping of the work piece by the movable clamping claw of eccentric arc face in conjunction with tne present invention.

FIG. 83-9 shows the three-dimensional view of the rubber and metal clamping faces provided on the wooden square movable clamping claw in conjunction with the present invention.

FIG. 83-10 shows the three-dimensional view of the rubber, wooden or other metal clamping face provided on the iron or steel square movable clamping claw in conjunction with the present invention.

Figure 1:
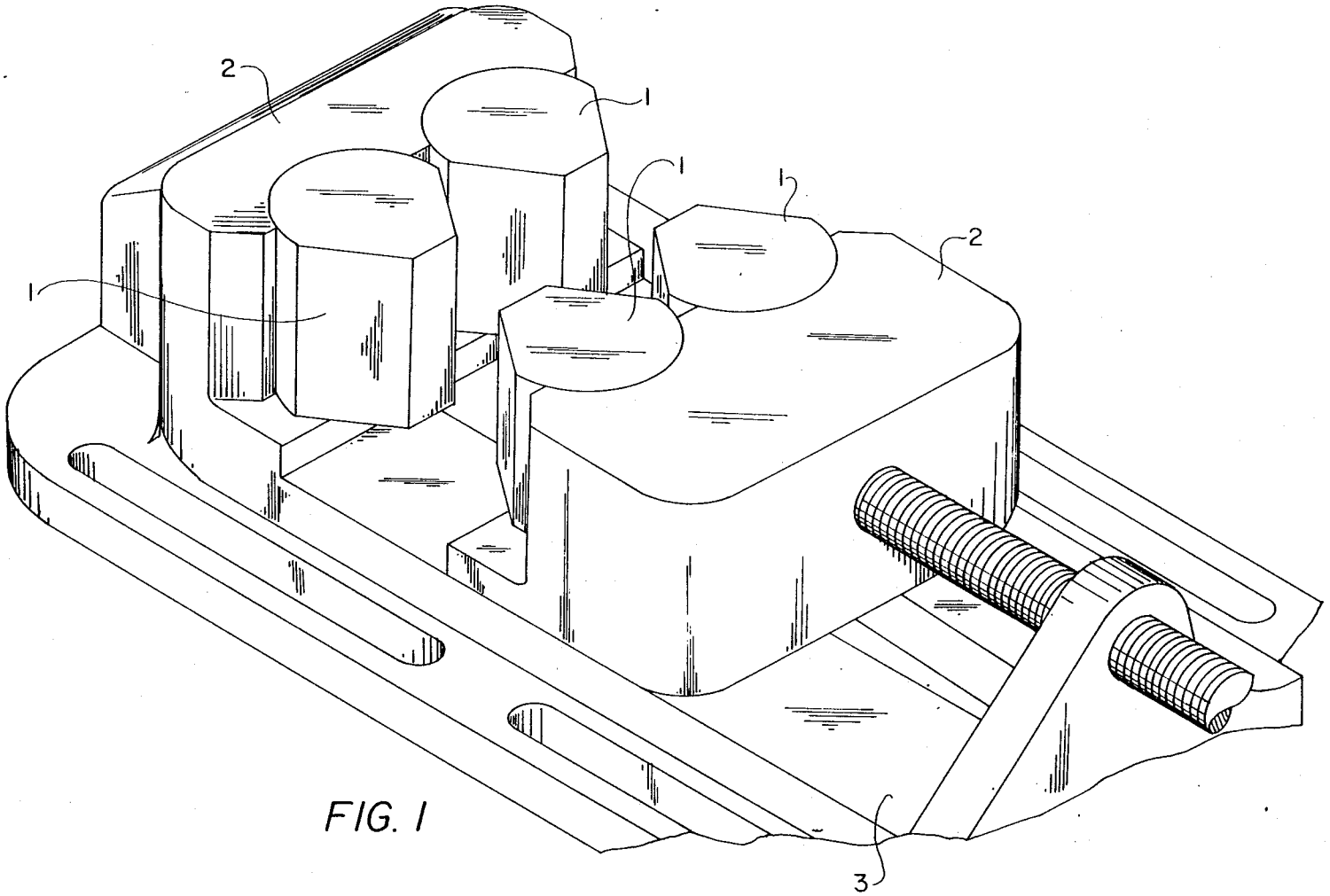
FIG. 1 shows the three-dimensional view of the servo-clamping device relative to the movable clamping claw with a a concave clamping surface of the exemplary example in conjunction with the present invention.

The main constituent structure of the servo-clamping device under the present invention composes movable clamping claw, clamping jaw group, driving device, and base seat which are separately described in sequence as follows:

Movable clamping claw 1 is a cylinder in a proper length, whereas the clindrical ring is in a form of full round ring rim at a proper angle and, when positioned at clamping jaw 2, serves as rotary slide face, while its other part will, at a proper angle, symmetrically or assymmetrically stretches out the clamping face with a trapezoidal cross section; the top face of this trapezoid is a smaller clamping face as shown in FIG. 1; movable clamping claw 1 can be positioned, adjusted and rotated in positioning seat 21 of clamping jaw 2 along the round back of this movable clamping claw.

As shown in FIGS. 2, 3, 4, 5, 6, 7, 8, 9, and 10, movable clamping claw 1 can be provided in an equal number and opposite positions or an unequal number and staggered positions on each side of clamping jaw group 2, by which the clamping face of movable clamping claw 1 can be rotated, and adjusted as desired to make the clamping device of the present invention easily clamp triangular, round, elliptic, diamond, parallel or irregular work pieces in different sizes and also make various movable clamping claws 1 tightly clamp the work piece with the clamping direction of various bearing forces concentrated at the central position of the work piece by all possible means.

As shown in FIGS. 11, 12, 13 and 14, the part of the clamping face of movable clamping claws 1 can, along with the situation needed, be made with a trapezoid with its top face in a concave arc or equilateral polygon or plane and concave and convex cylindrical face in different sectional radii and arrayed in order of sizes or vertical wheel teeth; also their various clamping faces can, according to their respective shapes, be cut and provided with longitudinal or latitudinal or oblique concave slots in an equal depth or their various clamping faces can be embossed with patterns as its feature.

Figure 15:
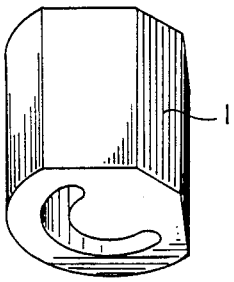
FIG. 15 shows the three-dimensional bottom view of the movable claw of the exemplary example in conjunction with the present invention.
Figure 16:
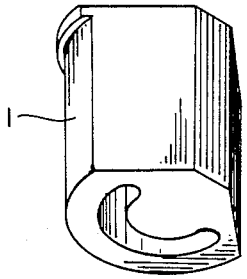
FIG. 16 shows the three-dimensional bottom view of the convex rim of the top of the clamping claw of the exemplary example in conjunction with the present invention.

On the back position of the coordination round arc at the bottom of the above-cited clamping claw 1 is provided with arc guide slot 18 in a proper depth and width and with an arc to accommodate fixing shaft 101 when positioned in positioning seat 21 of clamping jaw group 2 in order limit the maximum rotary scope of movable claw 1 as shown in FIG. 15; its top can have a flange with the small joint in a bigger form as shown in FIG. 16, which, when movable clamping claw 1 is set in positioning seat 21 of clamping jaw group 2, makes the elevated part of movable clamping claw 1 have a larger rotary rim of the back part to fully cover up the rotary connection seam between clamping jaw 2 and movable clamping claw 1, which, in turn, prevents very small and fine residual dedgs left by the work pieces forming falling into the connection seam to damage positioning seat 21 or the slide face of movable clamping claw 1 during the clamping and processing work.

Figure 17:
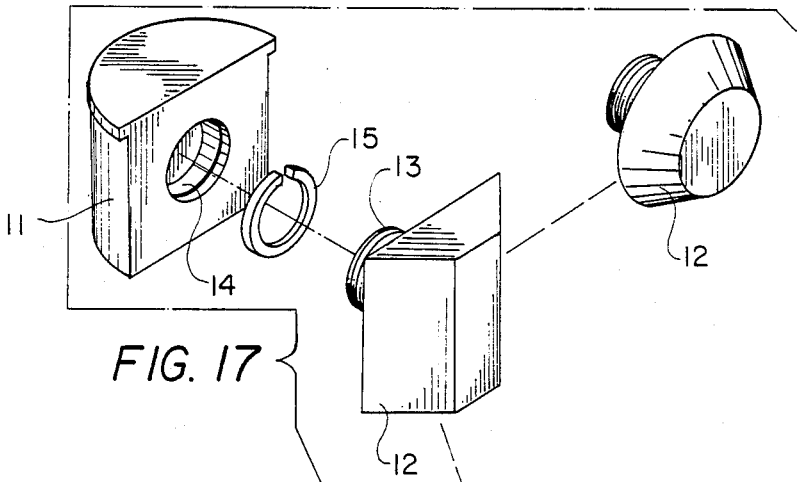
FIG. 17 shows the three-dimensional parts exploded view of the knockdown movable claw of the exemplary example in conjunction with the present invention.
Figure 18:
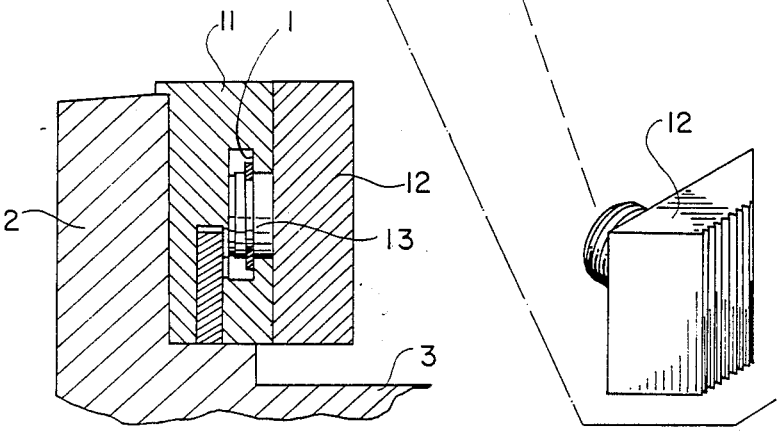
FIG. 18 shows the profile view of the knockdown movable claw of the exemplary example in conjunction with the present invention.

As shown in FIG. 17, movable clamping claw 1 under the present invention can also be composed by semi-cylinder 11 and compensatory block 12; from the center of semi-cylinder 11 or compensatory block, extends out rotary shaft or the center of semi-cylinder 11 or compensatory block has central shaft hole 14 to accommodate the rotary shaft penetrating into and installing in central shaft hole 14, a press-down spring 15 is to position the rotary shaft; on rotary shaft 13, semi-circular slot with a fixed arc length is provided; at the opposite position in central shaft hole 14, one or more sets of springs 17 and steel beads 16 are installed to make compensatory block 12 rotatable and adjustable, and also steel beads 16 are used to couple the changeable positions of this semi-circular slot, thus making sound indications of the fixed rotational torque.

As shown in FIG. 19, movable clamping claw 1 of the present invention to clamp work piece can also, by fixing shaft 101, be positioned in positioning seat 21 of clamping jaw group 2 or in slidable slide seat 201, whereas this movable clamping claw 1 can be a cylinder, or polygon, in a proper thickness, or in the form that, at a proper arc, the cylindric face of a cylinder is cut flat and on the rest arc rim, concave and convex arcs parallel to the central line are made in different radii and arrayed in sequence, and concave and convex arcs are made in different sectional roundnesses large and small tooth forms in different depths and in different radii in longitudinal cylindrical face; spring 17 and steel beads 16, which are set in advance in movable clamping claw 1, and the semi-circular slots which are drilled and provided at equal intervals on the perimeter of fixing shaft 101 can form multi-functional and movable clamping claw 1 with audio and adjustable and rotatable features between movable clamping claw 1 and fixing shaft 101 in design.

The above-cited movable clamping claw 1 consists of small and large tooth forms in proper cylindrical arcs which can be arrayed in order of sectional roundness and tooth depths; in various tooth slots, square longitudinal grooves are cut, whereas the connection part between the tooth faces and the square longitudinal slots forms in an arc formation, or a tooth tip and arc formation; besides, the longitudinal cylindrical arcs of movable clamping claw 1 are in different radii with respect to the arc positions; as to the convex arc as shown by line A—A in FIG. 20, if they are on other cross sections, the radii of their arcs are different from one another, just as the concave arcs shown by line B—B in FIG. 21; as to the above-said multi-functional movable clamping claw 1, it is also possible to cut V-shaped slot in the central ring on the cylindrical face as shown in FIG. 22 as the feature.

As for the multi-functional movable clamping claws 1 under this design, its fixing shaft locked by the conventionally used mechanical positioning and locking method in positioning seat 21 or slide seat 201 of clamping jaw group 2; if both of the fixing jaw and the movable jaw have the design of movable clamping claws 1 at the same time, movable clamping claws 1 on both ends can be provided symmetrically or positioned staggeredly; when multi-functional movable clamping claws are clamping a work piece, movable clamping claws can, according to the outer configuration of the work piece, be rotated to select proper clamping faces to clamp the work piece or slide seats 201 are adjusted simultaneously to make movable clamping claws 1 get the best clamping position, so that even the common tooth faces, arc faces or angular bodies in different sizes can be clamped tightly under the status of not being dammaged to successfully complete the processing operations.

Figure 23:
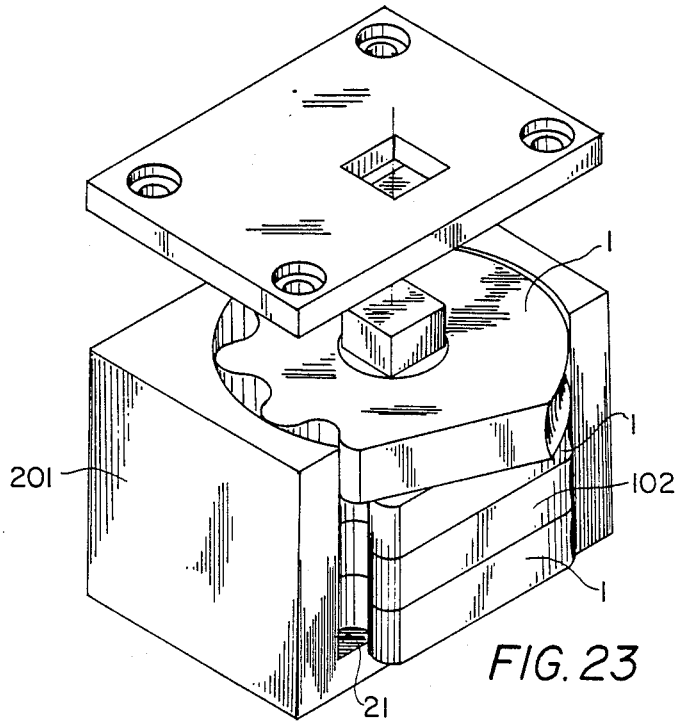
FIG. 23 shows the three-dimensional view of the multi-layer and multi-functional movable claw positioned by the slide seat in conjunction with the present invention.

Device of the multi-functional movable claws 1 on the above-said clamping jaw group 2 or slide seat 201 can be in a form of a single fixed shaft with only one multi-functional movable clamping claw 1 or with multi-layer individual movable clamping claws 1 as shown in FIG. 23; clamping jaw group 2 which is installed with multi-layer movable clamping claws 1 can be in a form of integral structure, in which only positioning seat 21 is cut and provided for the rotations of movable clamping claws 1 in orderto reinforce the strength of this integral body; when this design is applied to clamping jaw group 2, they can be set in a parallel installation with several fixed shafts 101, and each of them has a single or multi-layer movable clamping claws 1 as a special feature; clamping jaw group can also have multi-layer movable clamping claws 1 whereas support ring 102 in a bigger diameter is installed between layers or in a group of several layers and the arc rim of exposed over the clamping faces is cut flatly to directly support or bear clamping jaw 2 or slide seat 201 so as to reinforce the integral structure.

Figure 24:
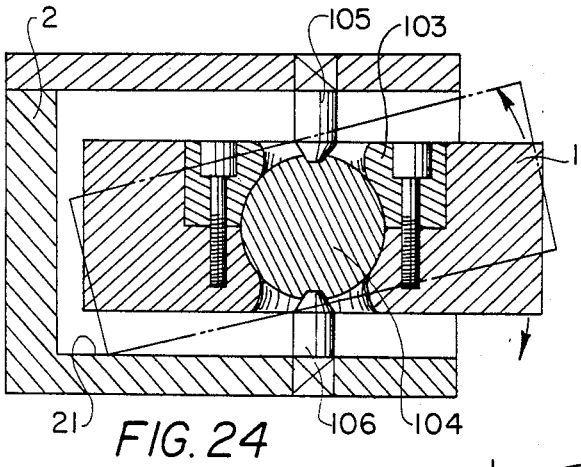
FIG. 24 shows the cross-sectional view of the movable claw positioned by the ball shaft on the clamping jaw and adjustable by three-dimensional swing in conjunction with the present invention.
Figure 25:
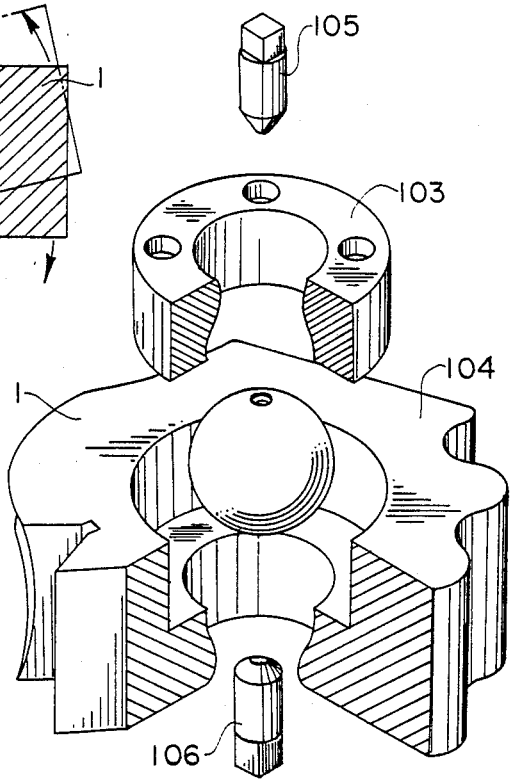
FIG. 25 shows the three-dimensional parts exploded view of the ball shaft and the multi-functional movable claw in conjunction with the present invention.
Figure 26:
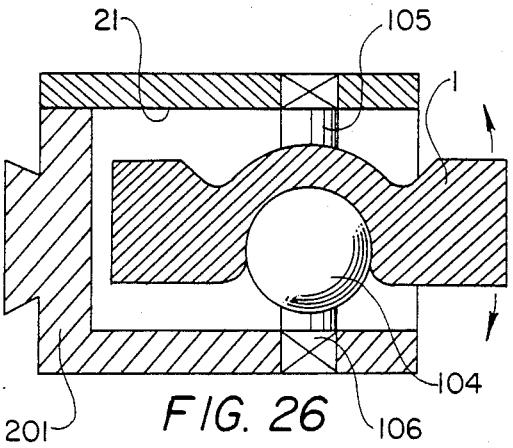
FIG. 26 shows the cross-sectional view of the movable claw positioned by the separable ball shaft in conjunction with the present invention.
Figure 27:
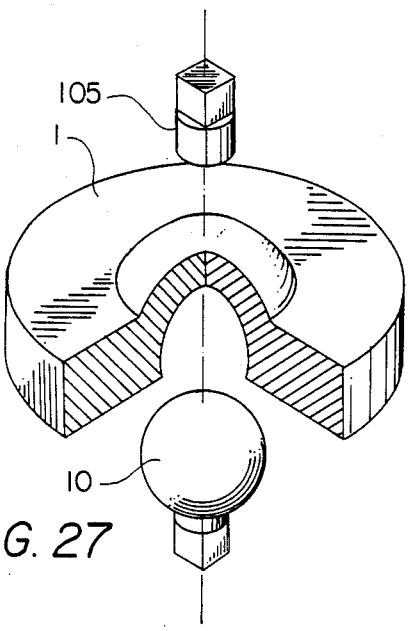
FIG. 27 shows the three-dimensional view of the separable ball shaft and movable clamping claw in conjunction with the present invention.

The present invention can further make the above-cited multi-functional movable clamping claws 1 have a three-dimensional swinging function as shown in FIGS. 24 and 25, wherein the main structure is composed with movable clamping claws 1, clamping ring 103, ball 104, and upper and lower positioning shafts; clamping ring 103 and movable clamping claws 1 are coupled into a ring-shaped post by bolts and after coupled they form a ball socket just to cover ball 104, this ball socket goes up and down and forms an arc and smoothly sliding opening to allow upper and lower positioning shaft 105 and 106 easily penetrating this opening and also supporting the ball 104; thus by this way, movable clamping claws 1 can swing up and down or rotate in the box-type jaw or slide seat 201 to pick up the best clamping position. Furthermore, the above-cited design can be an integral movable clamping claws 1, thus one side of its central part is in a ball-type concave form and its other side is in ball-type convex form, and both of these two ball arcs have a same center as shown in FIGS. 26 and 27; its concave socket seat is coupled and supported by a separately ball 104, while the other convex side is supported by the concave arc end of upper positioning shaft 105, and it can also make a part of a ball 104 sunk in slide seat 201 or the frame of clamping jaw 2 in order to reinforce the stability of ball 104; the central concave arc and convex arc of movable clamping claws 1 of this design can be rotated and adjusted at the same center to get the best clamping position.

Figure 28:
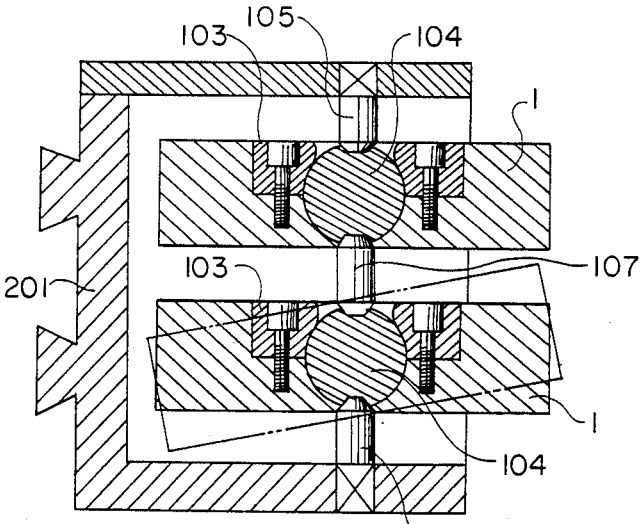
FIG. 28 shows the cross-sectional view of the assembly of the multi-sectional and multi-layer ball shaft and movable claw in conjunction with the present invention.
Figure 29:
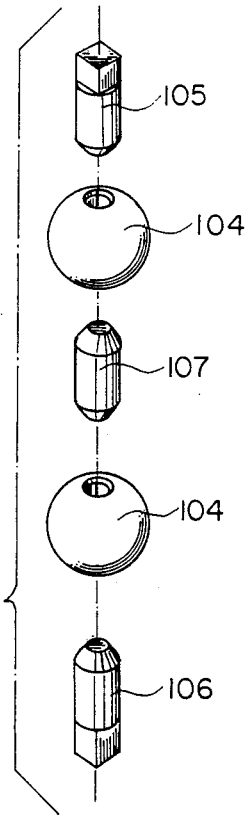
FIG. 29 shows the three-dimensional parts exploded view of the multi-sectional and multi-layer ball shaft and movable claw in conjunction with the present invention.

This invention features in the design of the rotational center by ball 104 for the multi-functional clamping claws 1, or this can be designed in multi-layer ball 104, which is connected by central shaft 107 to form multi-layer movable claws 1 in its structure as shown in FIGS. 28 and 29, and this structure can even clamp work pieces in more complex geometric forms.

Figure 30:
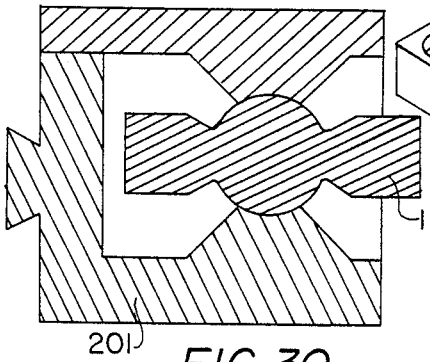
FIG. 30 shows the cross-sectional view of the movable claw with a ball center in conjunction with the present invention.
Figure 31:
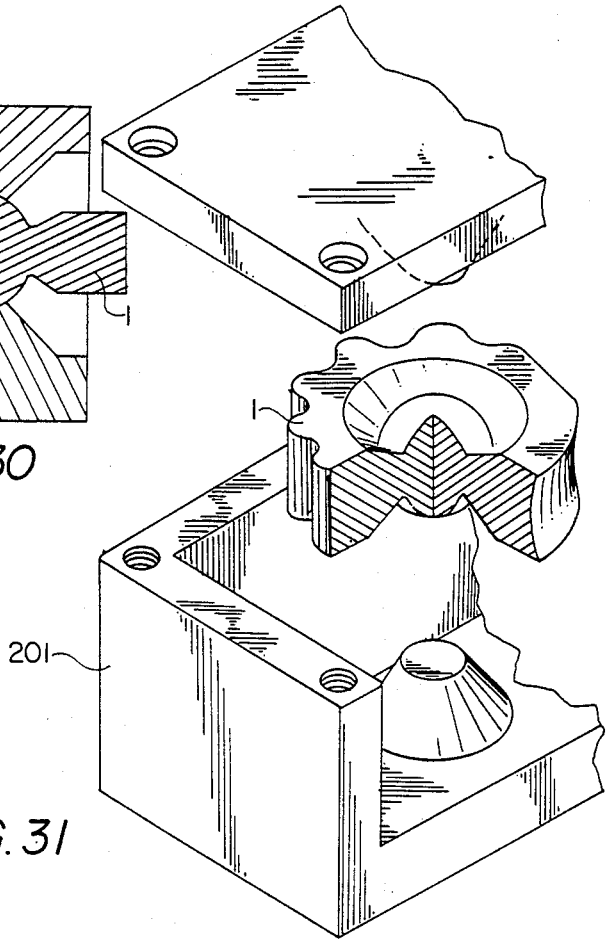
FIG. 31 shows the three-dimensional parts exploded view of the multi-functional movable clamping claw with a ball center in conjunction with the present invention.
Figure 32:
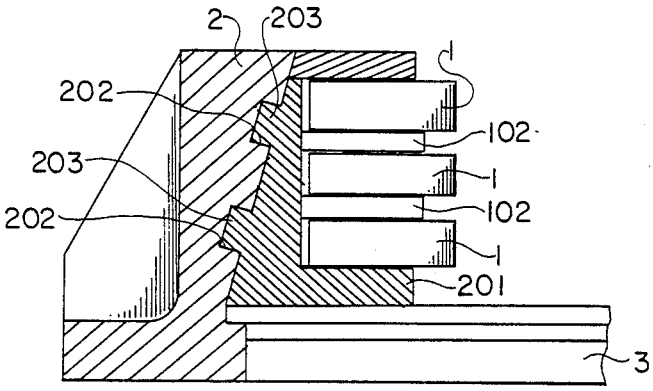
FIG. 32 shows the cross-sectional view of the assembly of the clamping claw and the slide seat with angular locking-up functions in conjunction with the present invention.

The above-cited design can also be an integral body composed of multi-functional movable clamping claws 1 and ball 104 as shown in FIGS. 30, 31 and 32, which are coupled simply by upper and lower positioning shafts 105 and 106 (their end faces are in a form of concave arc), or slide seat 201, or clamping jaw 2, which enables multi-functional clamping claws 1 also making three-dimensional adjustments and swingings.

Figure 33:
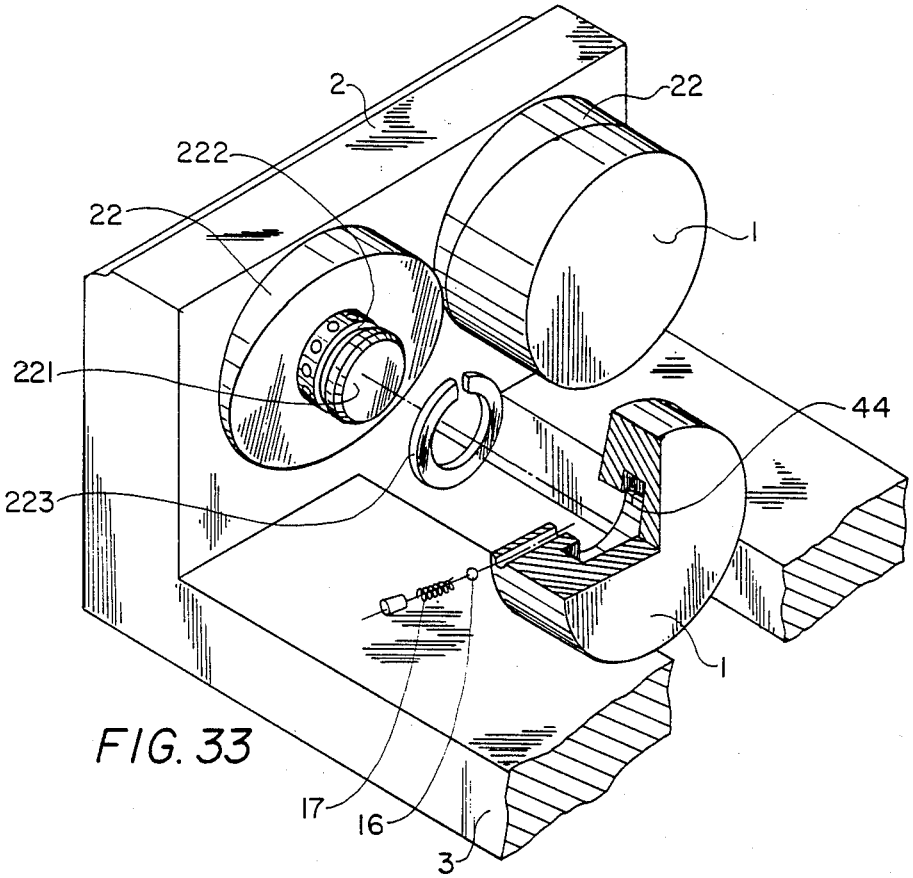
FIG. 33 shows the three-dimensional view of the fixing jaw with two movable clamping claw groups in conjunction with the present invention.
Figure 34:
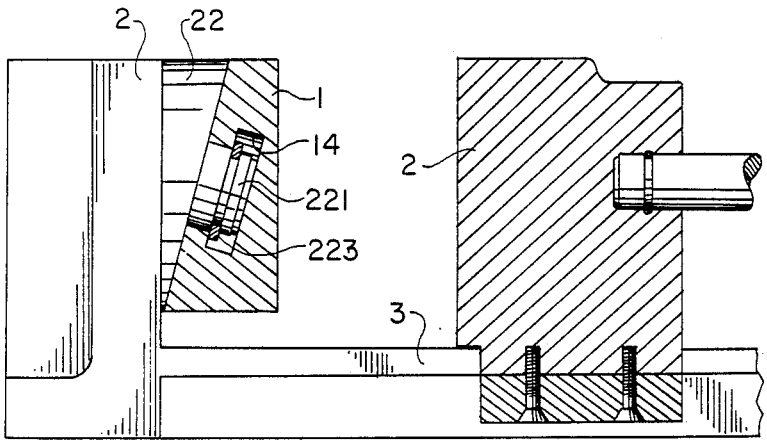
FIG. 34 shows the view of the clamping block group of the fixing jaw in conjunction with the present invention.

As shown in FIG. 33, movable clamping claws 1 of the servo-clamping device of this invention can further be in a form of the clamping side of the clamping jaw in the same body or an auxiliary block 22 which can make rotary adjustments and is also in a position between movable clamping claws 1 and clamping jaw 2, the center of this auxiliary block 22 can have perpendicular clamping face, however its end face is, according to the selected directions and slopes, cut into an oblique section, and along the center of this oblique section, post 221 perpendicular to this oblique section protrudes and the central line of this post 221 is not perpendicular to the clamping face of the jaw; concave slot 222 is provided at the near end of rotary shaft 13, whereas press spring 223 can be inserted into this concave slot 222 when movable clamping claw 1 is installed; as shown in FIG. 33, one end of the oblique cross section of auxiliary block 22 on the clamping face opposite to cylindrical movable clamping 1 is also cut into an oblique section, in the center of this oblique section, a positioning hole 14 is drilled and provided, and this positioning hole 14 has two stages, since the diameter of its inner aperture is bigger and the diameter of its outer aperture is same to that of post 221, as shown in FIG. 33, this makes press spring 223 inserted at the inner aperture into concave slot 222 of post 221 to couple the post body and the movable clamping claw, thus making the oblique sections of both of them closely contacted in a combination as shown in FIG. 34; the outer end face of movable clamping claw 1 has a perpendicular rim, this end face can, according to actual needs, be embossed with clamping patterns or engraved and provided with other geometric concave and convex structures to special work pieces.

As shown in FIG. 33, along the rim of the outer aperture of positioning hole 14 of movable clamping claw 1, one or more sets of steel beads 16, and spring 17 can be installed to coordinate with the semi-circular slots at equal intervals and in a ring form on the root of post 221 to make movable clamping claw 1 have audio equal amount micro-adjustments in directions.

Figure 35:
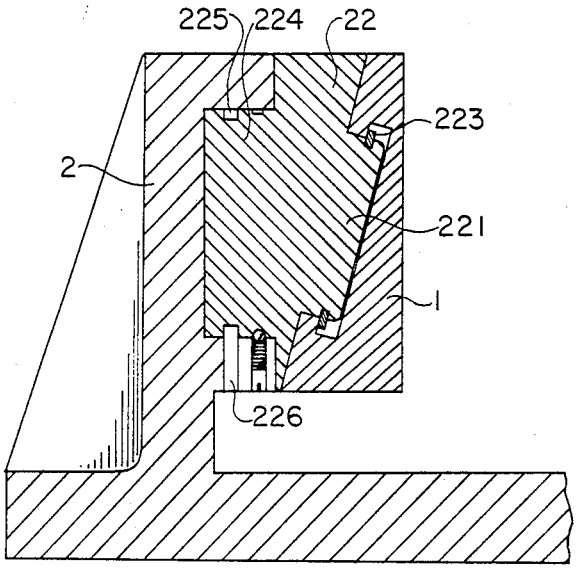
FIG. 35 shows the view of the rotable auxiliary block of the clamping jaw group in conjunction with the present invention.
Figure 36:
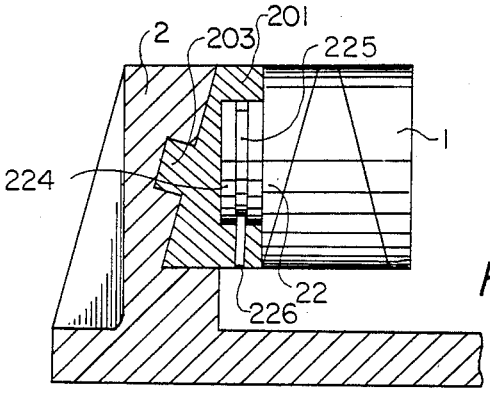
FIG. 36 shows the view of the multi-sectional movable clamping claw groups in conjunction with the present invention.

The auxiliary block 22 of the above-said design can be a separate body in respect to clamping jaw 2; as shown in FIGS. 35 and 36, a rotary hole is provided at a selected position on clamping jaw or slide seat 201 to accommodate the rotary post 224 (in a diameter same to that of this rotary hole) extended out from the back of auxiliary block 22; rotary post 224 is provided with round slot 225 in a ring form, so during positioning, a plug rod 226 penetrates through the bottom of clamping jaw 2 or slide seat 201 and then inserts in round slot 225 to avoid auxiliary block getting off clamping jaw 2; the designed plug rod 226 can be in a round or square form but its diameter or width must be equal to that of round slot 225, while audio equal amount rotary adjustment device is also set between rotary post 224 and clamping jaw 2.

Figure 37:
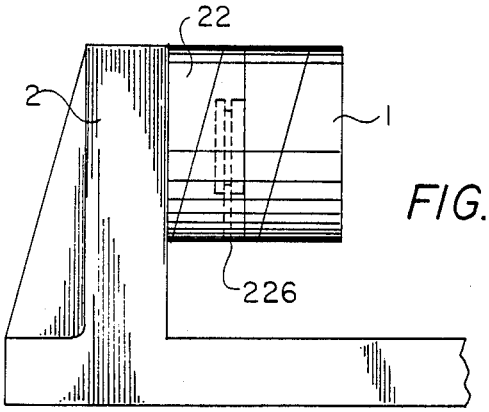
FIG. 37 shows the view of the multi-sectional movable clamping claw group with different oblique cross sections in conjunction with the present invention.

The movable clamping claw 1 of this design can also be composed by two or more sections as shown in FIGS. 36 and 37, both sides of which can have unidirectional or different directional oblique sections, or can also have an oblique section on its one end and a perpendicular plane on its other end, while the way of their connection is accomplished by post 221 and press spring 223 as above-cited, or is coupled by rotary post 224 and plug rod 226.

Figure 38:
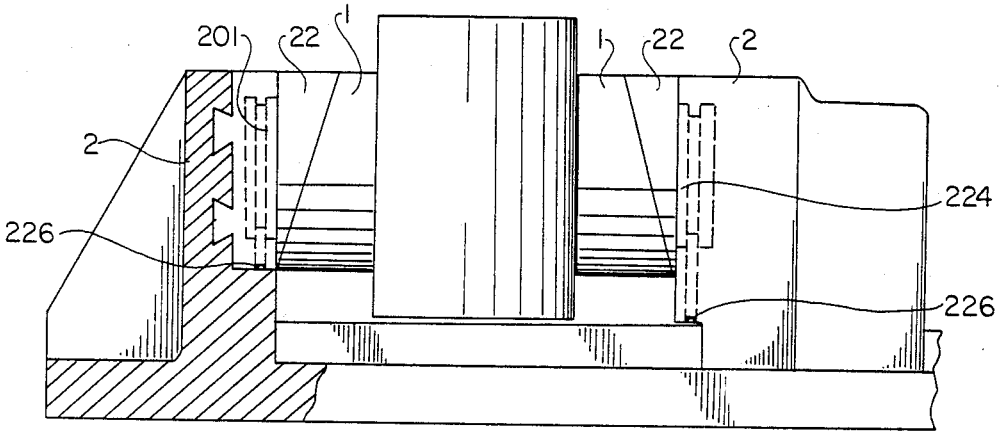
FIG. 38 shows the view of the rotable and rotary movable clamping claws clamping a work piece in conjunction with the present invention.
Figure 39:
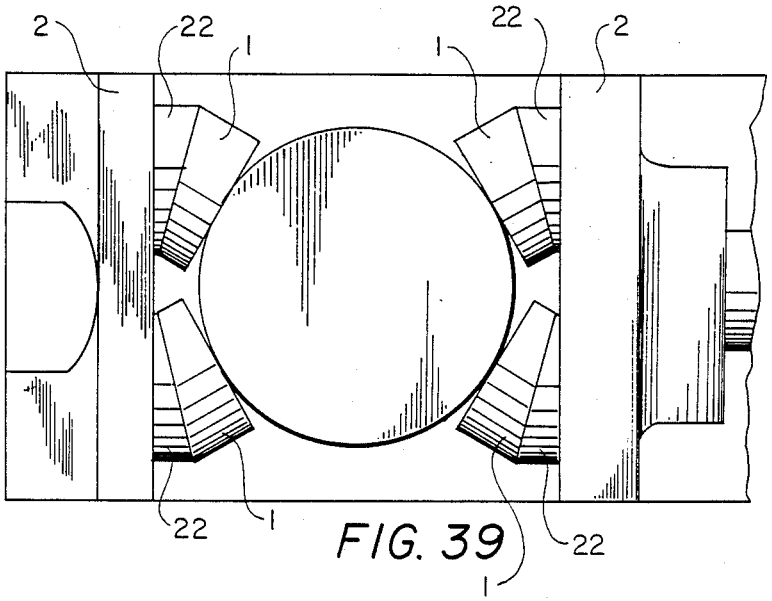
FIG. 39 shows the view of the rotable and rotary movable clamping claws clamping a work piece in conjunction with the present invention.

As shown in FIG. 38, auxiliary block 22 of the present invention can be positioned and rotated, by above-cited plug rod 226, in the clamping side of the clamping jaw or slide seat 201, so during its clamping of the work piece, this can adjust auxiliary block 22 to make space wider in the upper position and narrower in the lower position, thus forming the effective locking effects, or as shown in FIG. 39, this will adjust auxiliary block to make spaces wider in its outer side and narrower in its inner side, and then movable clamping claws 1 is rotated to sandwich ball-shaped work pieces.

Figure 40:
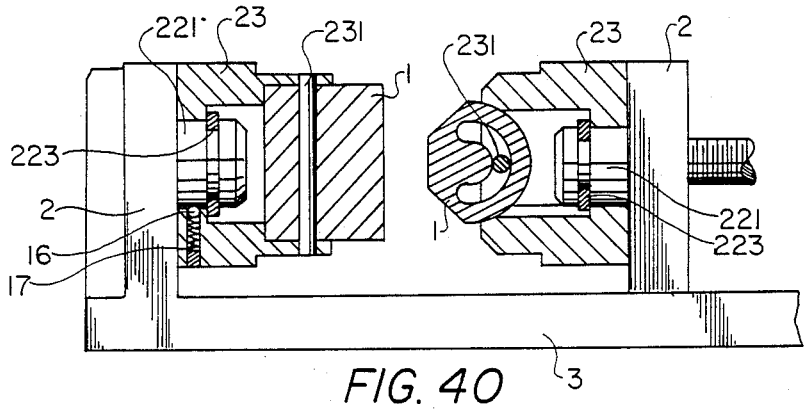
FIG. 40 shows the cross-sectional view of the assembly of the movable clamping claw rotable along rectangular coordinates in conjuction with the present invention.
Figure 41:
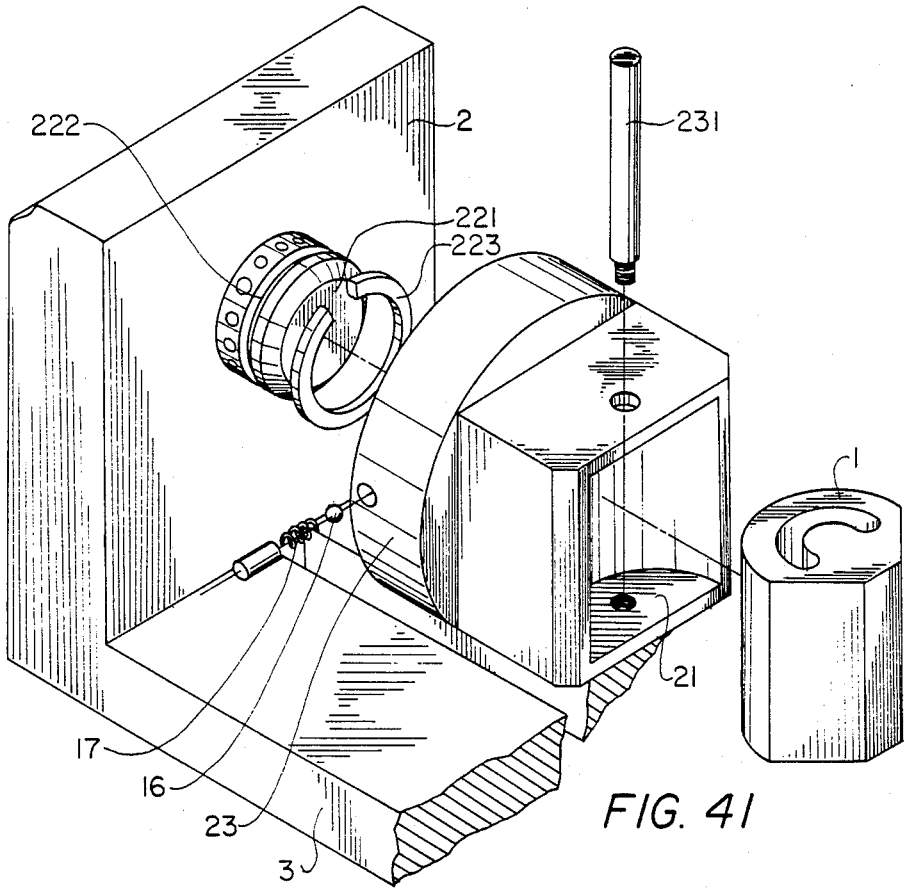
FIG. 41 shows the three-dimensional parts exploded view of the movable claw rotable along rectangular coordinates in conjunction with the present invention.
Figure 42:
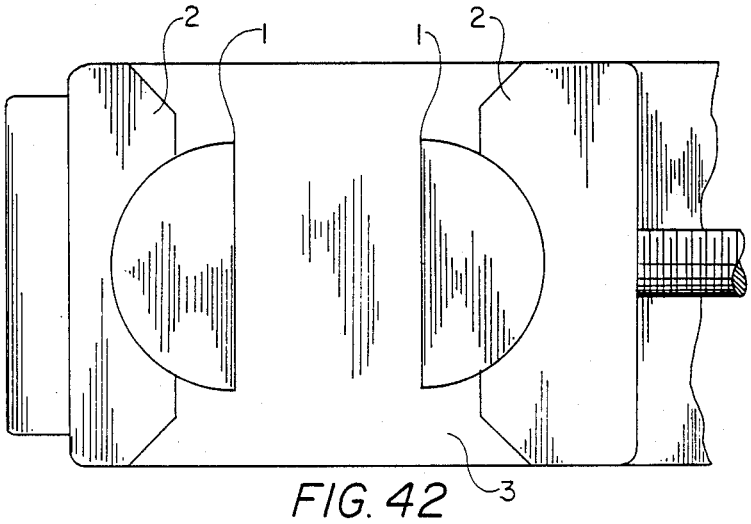
FIG. 42 shows the top view of the clamping jaw which clamps with its one side and has a single clamping claw in conjunction with the present invention.
Figure 43:
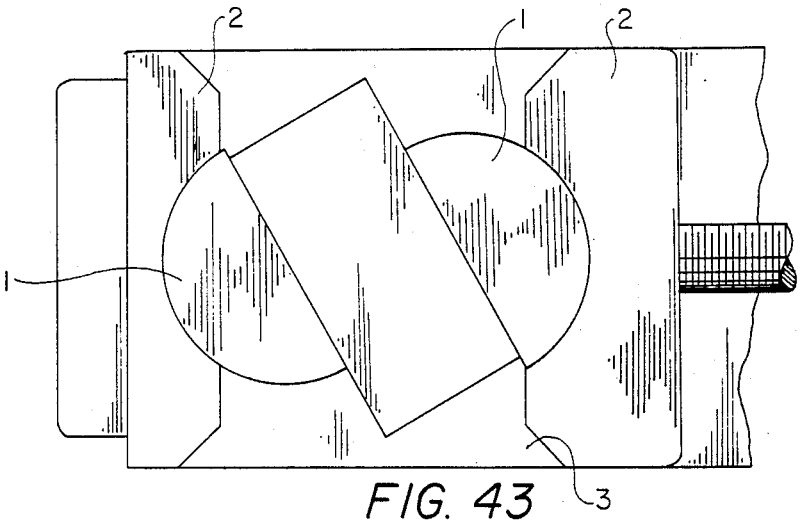
FIG. 43 shows the view of the one-sided clamping jaw with a single clamping claw clamping a work piece in an oblique way in conjunction with the present invention.
Figure 45:
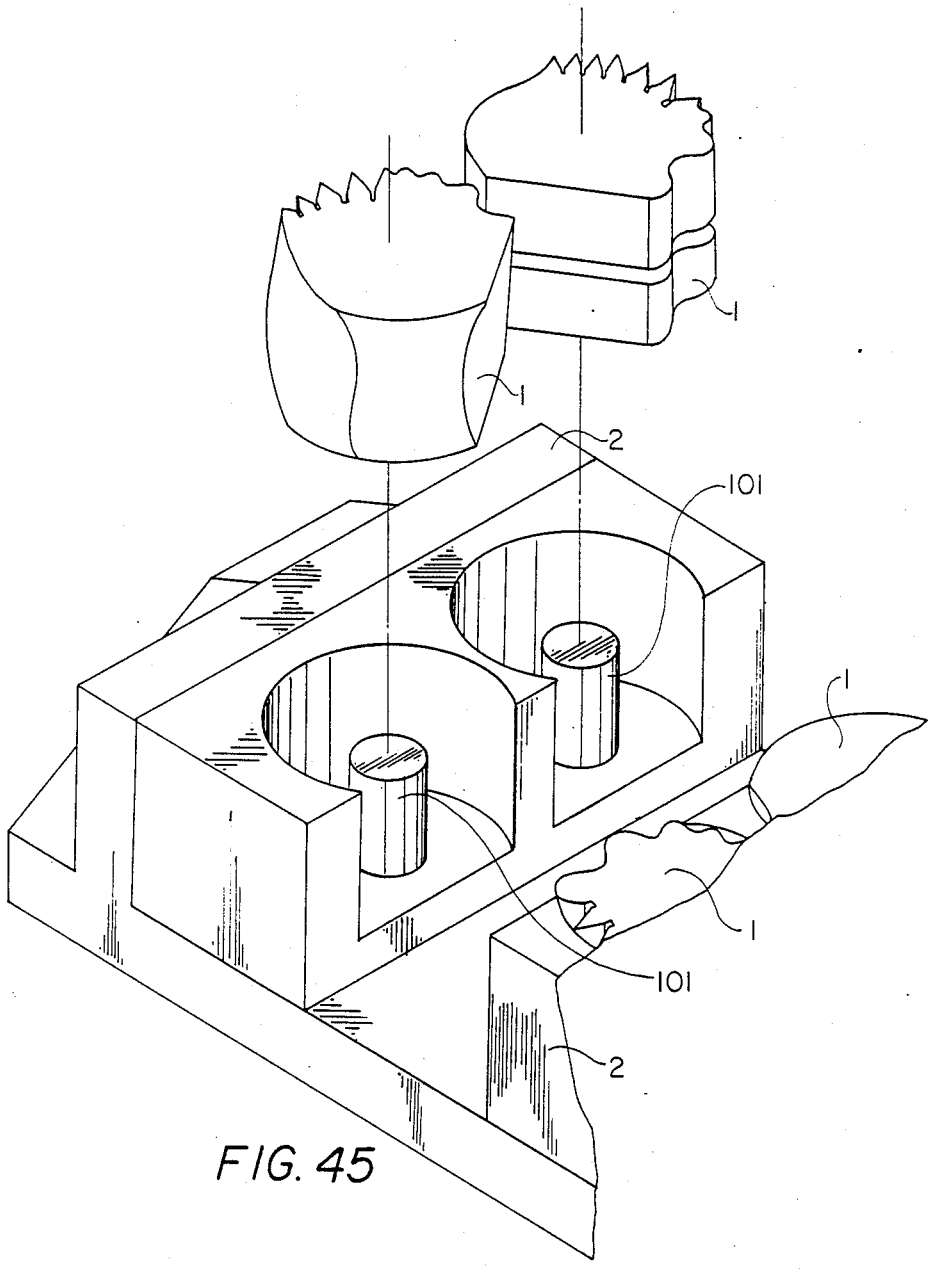
FIG. 45 shows the three-dimensional view of the open-type big arc positioning seat of the clamping jaw group which positions the clamping claws in conjunction with the present invention.
Figure 49:
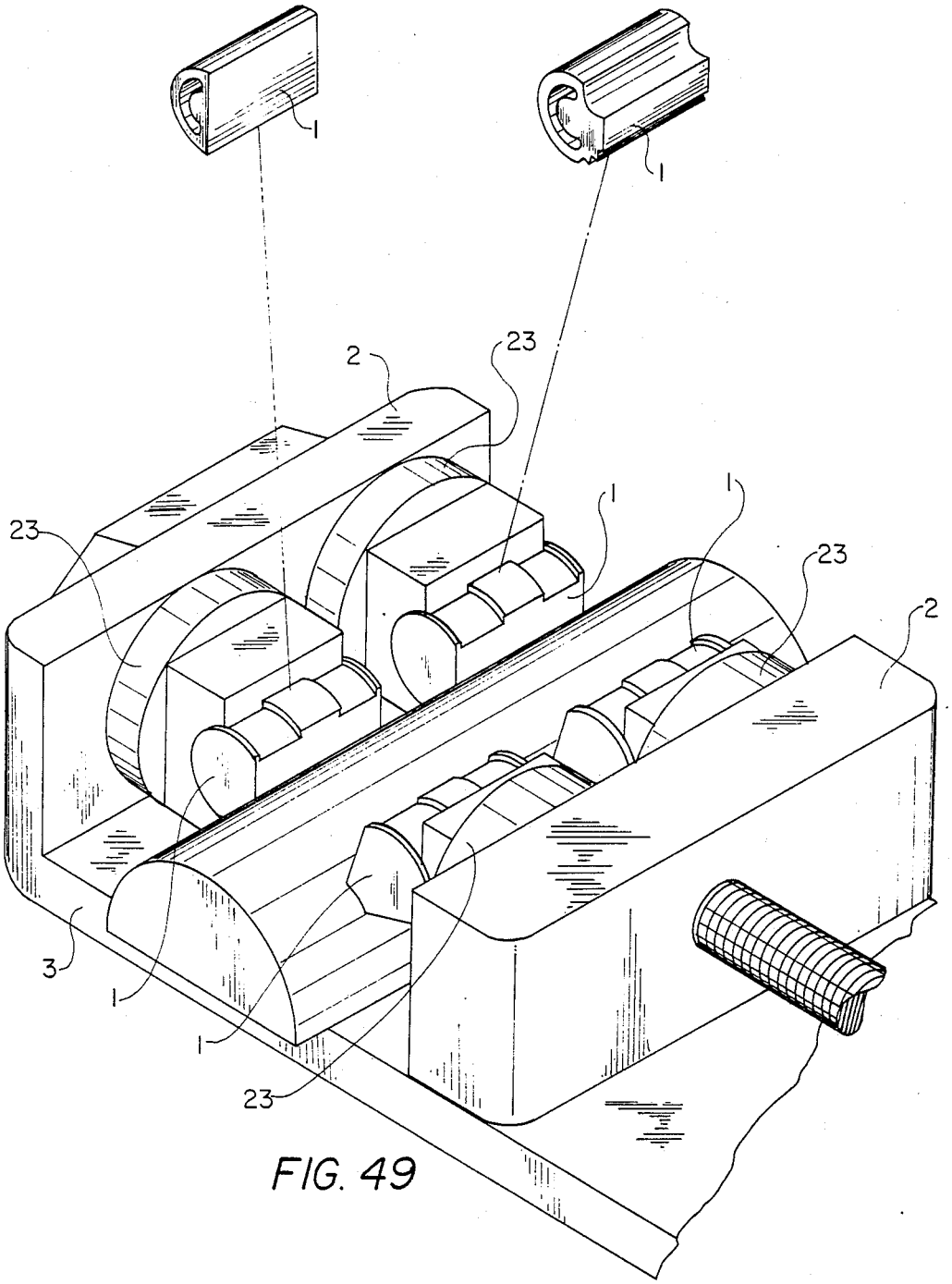
FIG. 49 shows the three-dimensional view of the clamping jaw group which holds down a semi-cylinder by its movable clamping claw rotable along rectangular coordinates in conjunction with the present invention.

The above-cited movable clamping claws 1 that have the rotary cylindrical face can be positioned by rotary base block 23, as shown in FIGS. 40 and 41, post 221 directly extends and protrudes out from the clamping side of clamping jaw 2 or protruded from auxiliary block 22 and then protrudes from post 221 and is coupled with base block 23 by press spring 223 to make this base block become a positioned rotary body or a rotational body along the oblique face of auxiliary block 22, the end of base block 23 of this design is in a form of rectangular body, concave arc positioning seat 21 is provided on the end face, one end of positioning seat 21 protrudes positioning rod 231 which penetrates through and presses movable clamping claws 1, or its both ends are provided with positioning holes to let positioning rod 231 penetrate through and stay to position movable clamping claws 1, or the arc wall of positioning seat 21 is provided with guide movable key or slot as shown in FIG. 49 to make movable clamping claws 1 with guide slot or key positioned and rotated. In this structure, movable clamping claws 1 can be in a form of a semi-cylinder or semi-cylinder with trapezoidal section and portions of its two ends protruding out from positioning seat 21 are made with protective lips in a larger radius to fully cover the top rim of positioning seat 21 of base seat 23; this design makes the position adjustments of movable clamping claws 1 can be firstly made by the rotation of base block 23 to change the direction of the post of movable clamping claws 1, and then rotated along the guide slot of movable clamping claws 1 themselves, thus forming rotations and displacements in rectangular coordinates to accomplish the micro adjustments on work pieces.

Figure 46:
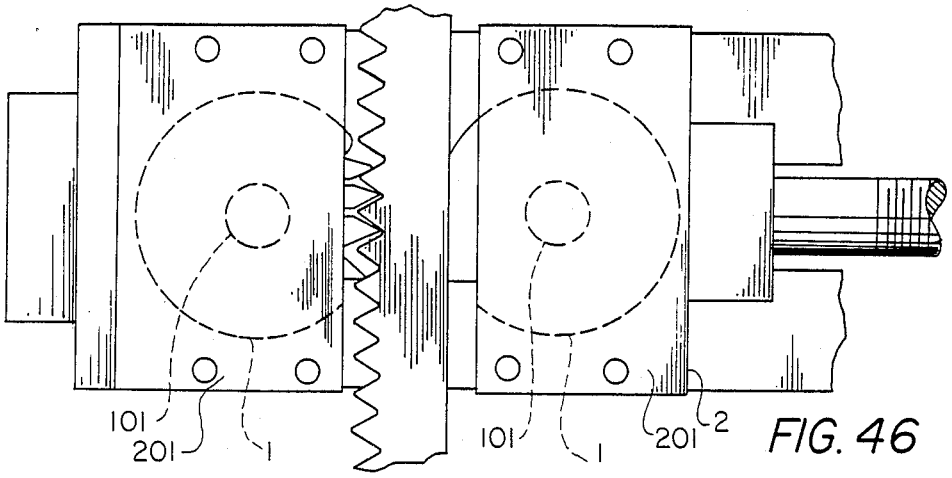
FIG. 46 shows the three-dimensional view of the clamping jaw group each of the two sides of which clamps the tooth-shaped work piece with its singular multi-functional clamping claw respectively in conjunction with the present invention.
Figure 47:
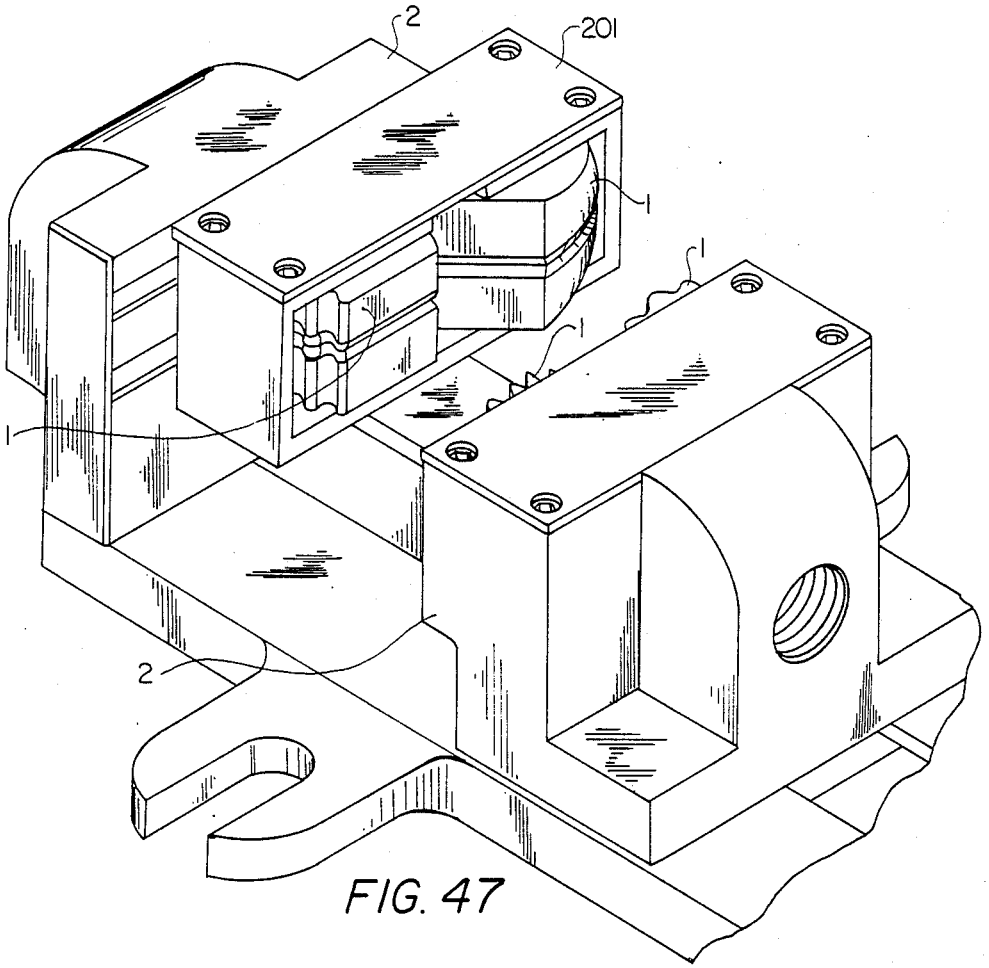
FIG. 47 shows the three-dimensional view of the box-type clamping jaw group with a slide seat and two movable clamping claws on one side of the clamping jaw group in conjunction with the present invention.

As shown in FIGS. 42, 43, 44, and 45, the clamping side of clamping jaw group of this invention can have a pair or more concave arc structure, or can also have concave structure with concave parts in different depths, such concave parts are the positioning seats 21 for movable clamping claws 1, a fixing shaft 101 or limit rod can protrude out from the center or non-central position of the arc to penetrate through movable clamping claws 1 to control the action position of movable clamping claws 1 or one or more guide keys or slots on the arc walls can engage opposite slots or keys on movable clamping claws 1; the clamping jaw group 2 of this design can also have a top cover structure to make the limit rod or fixing shaft 101 penetrate through and install in the top cover, so movable clamping claws 1 have better positioning and clamping effects as shown in FIGS. 46 and 47.

Figure 48:
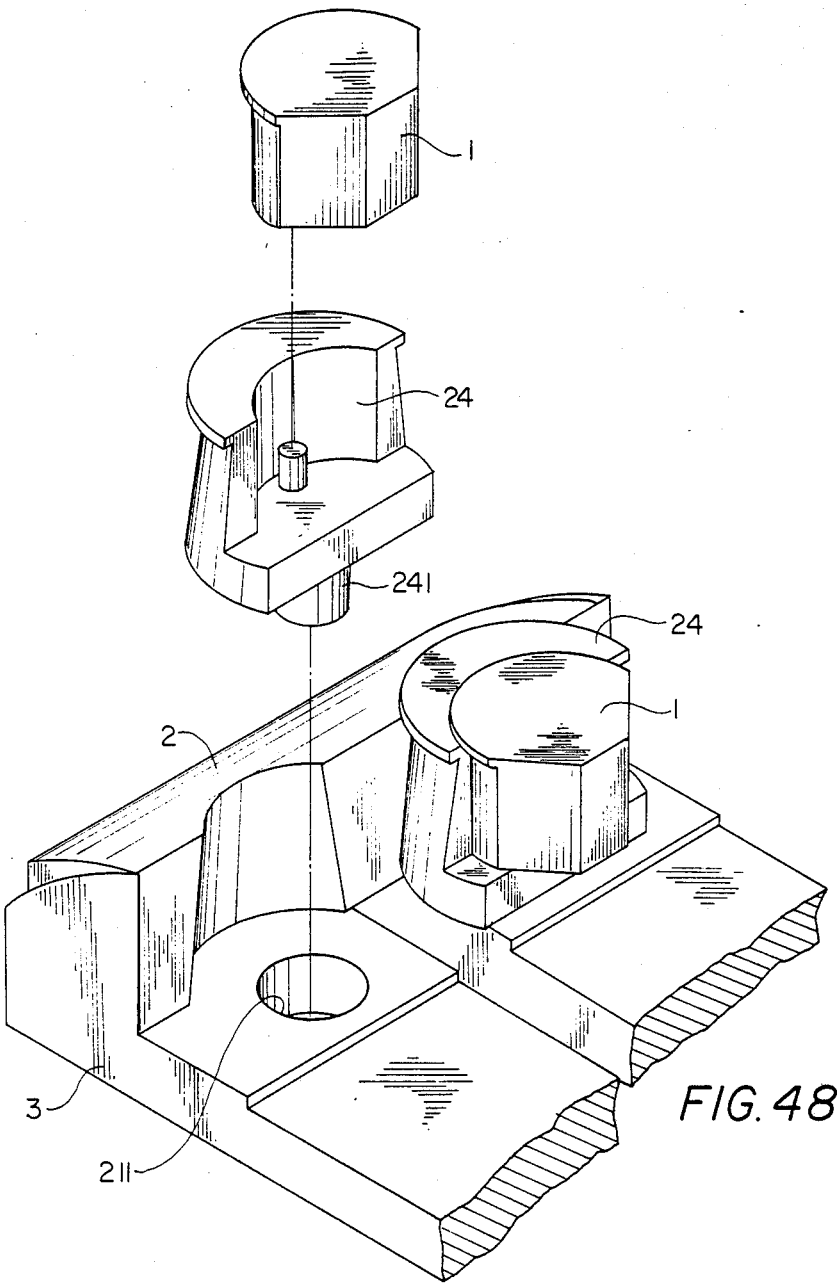
FIG. 48 shows the three-dimensional view of the clamping jaw group with individual rotary seats in conjunction with the present invention.

As shown in FIG. 48, the positioning movable clamping claw 1 of clamping jaw group 2 of this invention can be inserted into the bearing face of clamping jaw group 2 by individual rotary seat 24 and this then makes movable clamping claws 1 positioned on rotary seat 24, thus forming a design to change movable clamping claws 1 as desired. The radii of the arc wall of the clamping side of clamping jaw group 2 are different, whereas the radius on its upper part is larger and the radius of its lower part is smaller, and penertion and installation hole 211 is provided on clamping jaw group 2; the upper section of rotary seat 24 is in a form of a semi-cylinder, and, at the connection between its lower and upper sections, a comparatively protruting bearing face is provided; a plug rod 211 which is smaller than penetration and installation hole protrudes from the bottom of this bearing face; the upper and lower sections of rotary seat 24 form a semi-round body with its upper radius smaller than its lower radius, whereas this slope matches with the oblique arc wall of clamping jaw 2; the above-cited rotary seat 24 can, by a smaller plug post 241, be obliquely inserted into penetration and installation hole 211 of clamping jaw 2 and then rotated to be installed in the arc wall; the upper section of rotary seat 24 also has an arc concave wall in a proper arc and a limit rod to accommodate and position the above-cited various cylindrical movable clamping claws 1; movable clamping claws 1 of this design can, by rotations of rotary seat 24 and rotations of opposite rotary seat 24, form multiple adjustments as desired.

The rotary seat 24 and the rotary slide face of clamping jaw group 2 in the above-cited design has a structure of reverse clamping and side inclinations, therefore, when this structure is used to clamp a work piece, it can achieve tight and firm locking effects; again as to clamping jaw group 2 of this design, the reverse clamping side of its jaw top face declines downward, and rotary seat 24 or movable clamping claws 1 or rotary seat 24 and movable clamping claws 1 are all higher than the opposite coupling body and their higher parts have a larger radius to fully cover slide connection seam between their own body and opposite bodies as shown by the connection part in the related figure to prevent any small residual dedgs left by the work piece from falling into this connection seam and dammaging the wall face.

The clamping side of clamping jaw group 2 under the present invention can have a slide seat 201 (as shown in FIGS. 26, 28, 30, 32, 36, 38, 44, 45, 47, 50, 51, 52 and 53) which can be driven sideways in a straight line or arc line, positioned and firmly locked, of which the slide face of slide seat 201 and clamping jaw group 2 has been correspondingly provided with slide guide keyways for coupling, in other words, one has a dove-tail key, while the other has a dovetail slot as shown in FIGS. 26, 28, 30, and 38, or this can be coupled by rectangular slide slot 202 and rectangular 203 for sliding as shown in Fgis. 32 and 36.

For the above-cited design, the section of slide seat 201 can be in a form of trapezoid, as shown in FIGS. 32 and 34, clamping jaw 2 can be provided in a form of a wider body in the upper part and smaller body in the lower part or vice versa, rectangular slide slot 202 is cut and provided on its oblique slide face for the perpendicular slide face, thus, looking at the processing plane, this rectangular slide slot 202 is in a inclination status, with respect to rectangular slide key 203 of slide seat 201, the upper wall of this rectangular has insertion and catching function to make slide seat 201 and slide face of clamping jaw 2 keep a close contact status, and make the clamping face of slide seat 201 still maintain in a perpendicular status, and also make its bottom flatly stick to the bottom fixing body; rectangular slide slot 202 can, by a plug or blocking block, coverup its opening and; since rectangular slide key 203 of slide seat 201 is shorter, this makes slide seat 201 have a longer slide scope; when this design clamps a work piece, at one end of the wider clamping jaw, there appears a stronger pushing status, as shown in the upper part in FIG. 32, when a bigger force of the clamping work is applied, the upper end will not slip off the opening and impose firm locking and tightening function to the clamping of a work piece.

Figure 50:
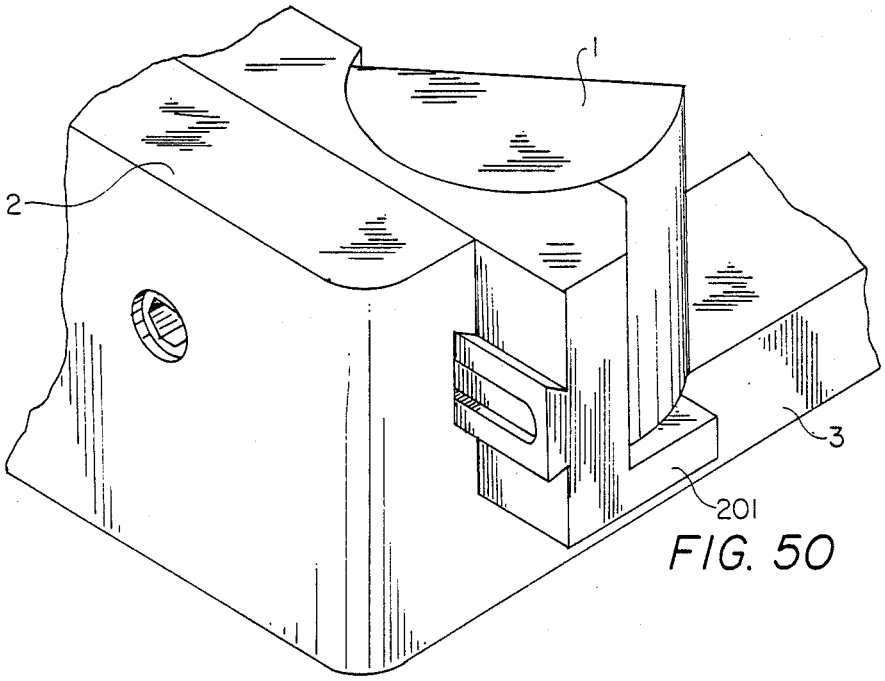
FIG. 50 shows, the three-dimensional view of positioning of the slide seat by the locking bolt of the dovetail keyway in conjunction with the present invention.
Figure 51:
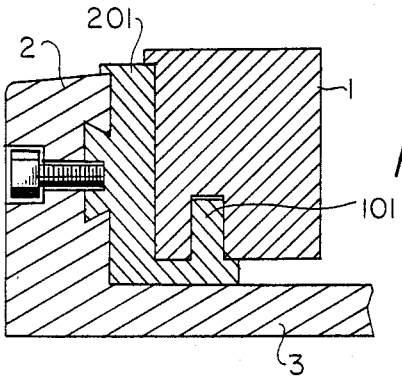
FIG. 51 shows the cross sectional view of the positioning of the slide seat by the locking bolt of the dovetail keyway in conjunction with the present invention.

As to the slide positioning way of the above-cited slide seat 201, a locking screw can be provided at a proper position on the slide face, after slide seat 201 is positioned, this can, from the body of clamping jaw 2, lock inwardly to tightly press against slide seat 201, or as shown in FIGS. 50 and 51, the guide keys are provided with concave limit slots to limit the penetration of the adjustment screw from the clamping back side.

Figure 52:
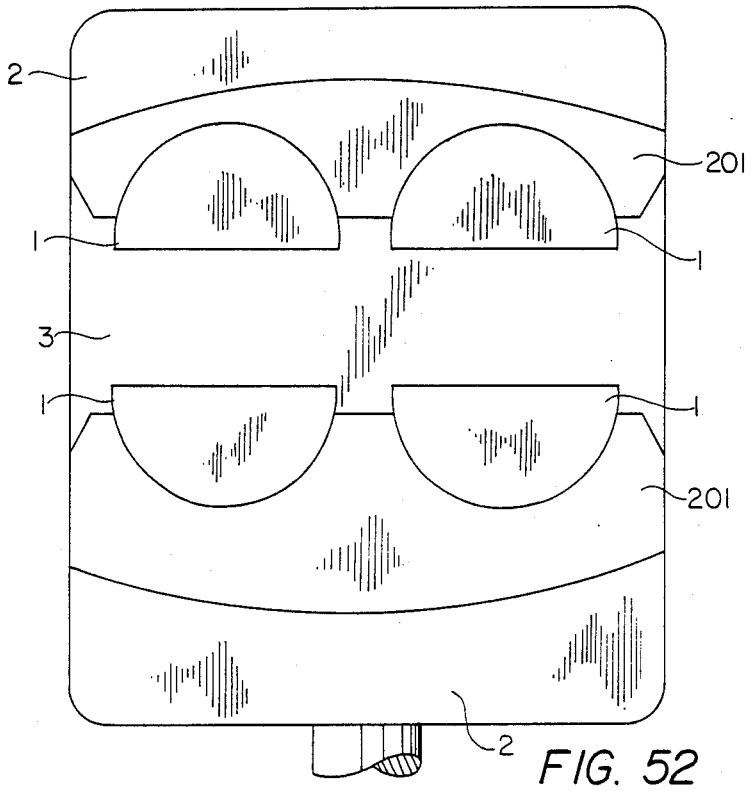
FIG. 52 shows the top view of the clamping jaw group with two-end guided movable positioning slide seat in conjunction with the present invention.
Figure 53:
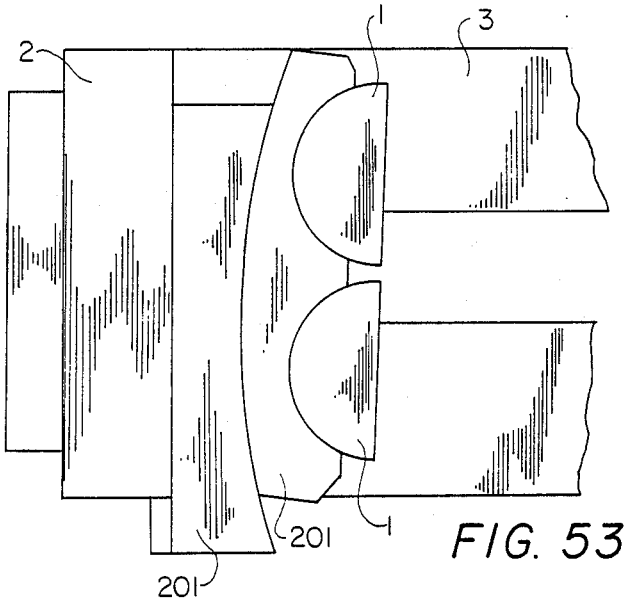
FIG. 53 shows the top view of the clamping jaw group with straight line and arc guided moving positioning slide in conjunction with the present invention.

As shown in FIG. 52, the coupling and driving structure of slide seat 201 and clamping jaw group 2 can be arc slide face with its arc in a proper radius to make slide seat 201 slide sideways to a set arc locus; this design can also be driven in coordination with sideways straight line locus, thus forming a multi-step combination, as shown in FIG. 53, it can have multi-step slide seats 201, whereas a straight line or arc slide face appears between each two adjoining slide seats 201 for micro-adjustments to tightly clamp the work piece.

The clamping face of slide seat 201 can be a plane with press embossed patterns or can be provided with the above-cited positioning seat 21 in order to install various kinds of semi-cylinders or multi-functional movable claws 1, or can also be, as an extention of the above-cited design, the auxiliary block 22 and base seat 23 to install rotatable and movable clamping claws 1, or can be the movable clamping claws rotatable along rectangular coordinates; the top face of this slide seat 201 and the top face of the clamping jaw group 2 that couples with this slide seat 201 can all be in a form of the reverse clamping side inclining downward, and the top face of slide seat 201 has a raised and protruding protective lip to fully cover up the connection seam between the coupling slide faces to expedite sliding and falling down of the residual dredgs left by the work pieces without falling into the connection seam as shown in FIG. 51; besides, this slide seat 201 can be in a form thinner in its upper part and thicker in its lower part, while the fixing seat of clamping jaw 2 is in a form thicker in its upper part and thinner in its lower part and its slide face is an oblique face with firmly locking functions.

Figure 54:
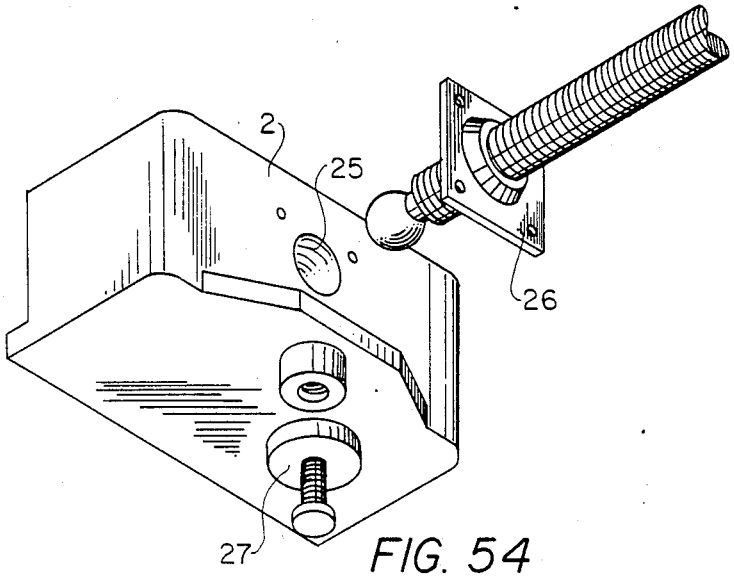
FIG. 54 shows the three-dimensional exploded view of the driving of the clamping jaw group by the socket seat and ring-and-post support block in conjunction with the present invention.
Figure 55:
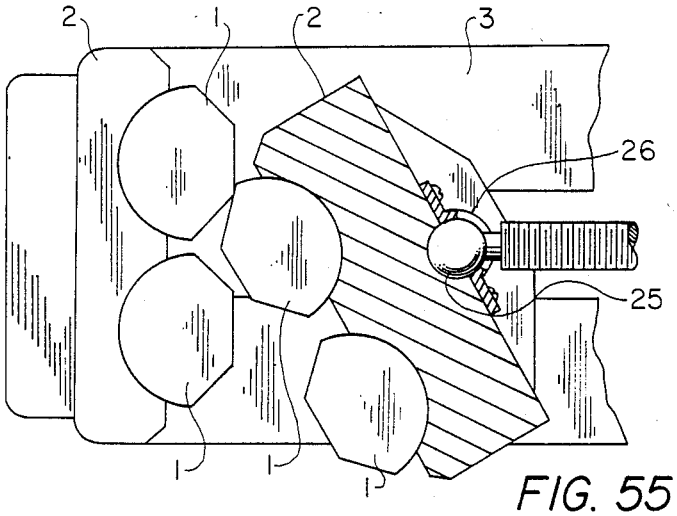
FIG. 55 shows the top view of the clamping of the work piece by the rotation of the clamping jaw group under the driving of the socket seat and ring-and-post support block in conjunction with the present invention.
Figure 56:
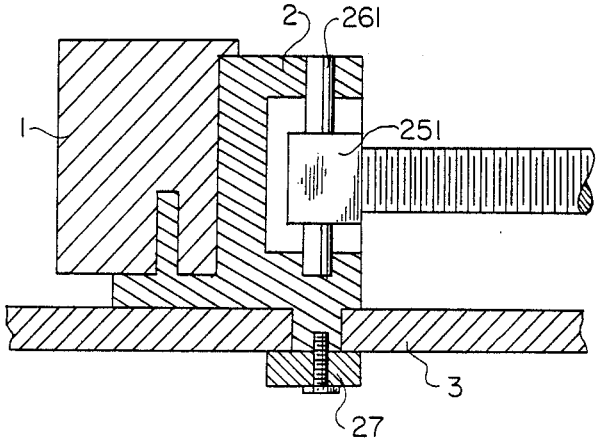
FIG. 56 shows the cross sectional view of the clamping of the work piece by the rotation of the clamping jaw group under the driving of the penetration rod and ring-and-post support block in conjunction with the present invention.
Figure 57:
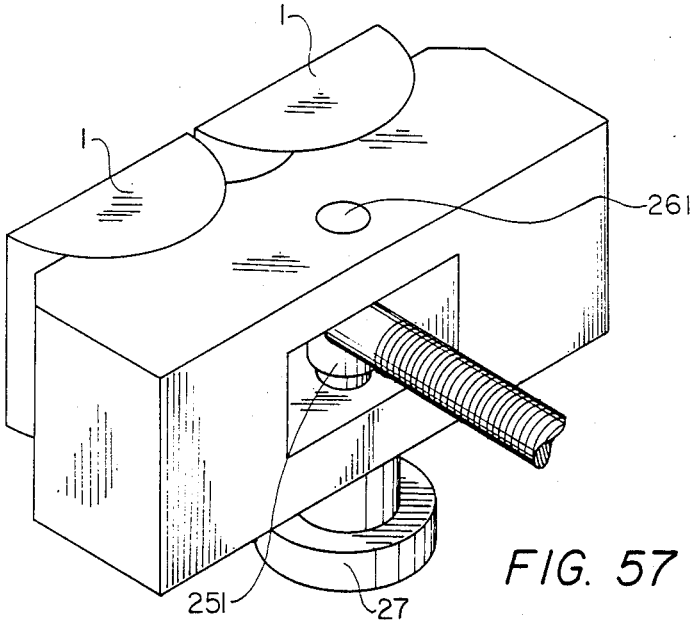
FIG. 57 shows the three-dimensional view of the go-through rod and ring-and-post support block to drive the clamping jaw group in conjunction with the present invention.

Clamping jaw group 2 under the present invention can also coordinate with the needs of the work pieces to make the slide jaw adequately adjust the clamping directions, and its structure is shown in FIG. 54, as socket seat 25 and a protective disc 26 are provided on the back of the slide jaw, the end of the guide screw is a ball-type body which penetrates into protective disc 26; right under the center of the bottom of the slide jaw which matches the socket seat, a ring-and-post support block 27 is provided, this support block 27 of the ring-shaped post is used for sliding in the guide slot on base seat 3; the ring-and-post support block 27 is in a form of cylinder, or the slide jaw can rotate a certain angle along the ring-and-post support block 27 as its rotary axis as shown in FIG. 55, whereas its maximum angle of rotation depends on the allowable scope of movements between the guide screw and protective disc 26, but it is necessary to maintain the initial driving position of the guide screw; by dint of the design of the top-pushing movable jaw of the socket seat 26, the above-cited guide screw can also be in a form that the end of this guide screw has a holding ring 251 to hold a positioning rod 261 which vertically stands on the back of the jaw body, and its ring-and-post support block 27 is at a position under the same center of the positioning rod 261 as shown in FIGS. 56 and 57.

Figure 58:
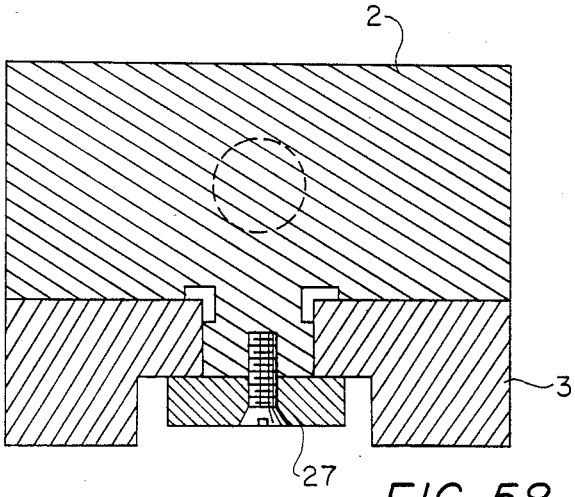
FIG. 58 shows the three-dimensional parts exploded view of the spherical coupling structure on the bottom of the clamping jaw group in conjunction with the present invention.

After the slide jaw of the present invention has been in installed the ring-and-post support block 27, an inward concave angle is cut and provided at the corner between the slide face of the slide jaw and the neck of the slide jaw extending downward, as shown in FIG. 58, the slide face between the bottom of the slide jaw and the jaw base seat, and the corner between the extended neck and guide slot arc most susceptible to damage during the sliding of the slide jaw, therefore the inward concave angle of the present invention make the turning angle between the slide face of the jaw base seat and the guide slot not subjected to frictions, thus there is no worry about any damage resulted.

Figure 59:
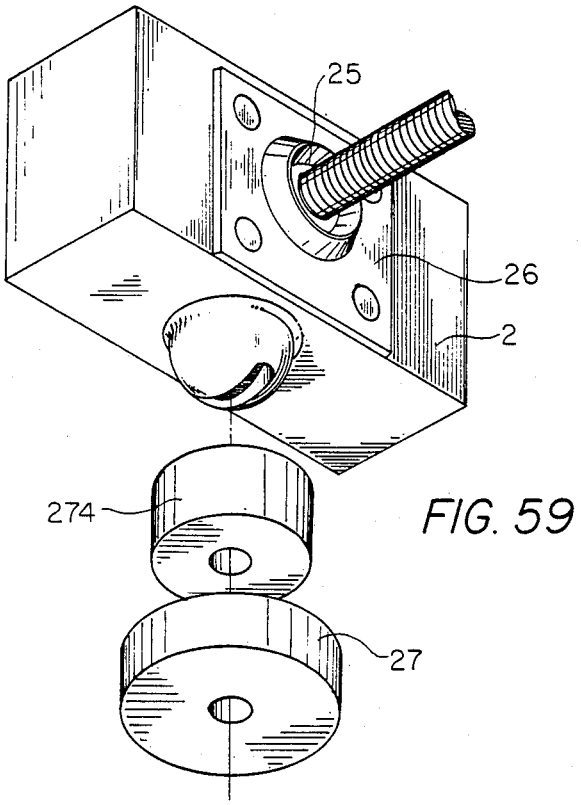
FIG. 59 shows the three-dimensional parts exploded view of the spherical coupling structure on the bottom of the clamping jaw group in conjunction with the present invention.
Figure 60:
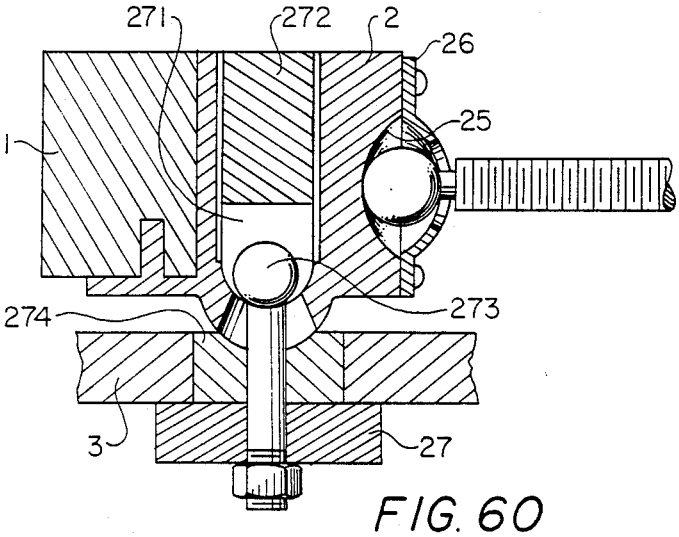
FIG. 60 shows the cross sectional view of the spherical coupling structure on the bottom of the clamping jaw group in conjunction with the present invention.
Figure 61:
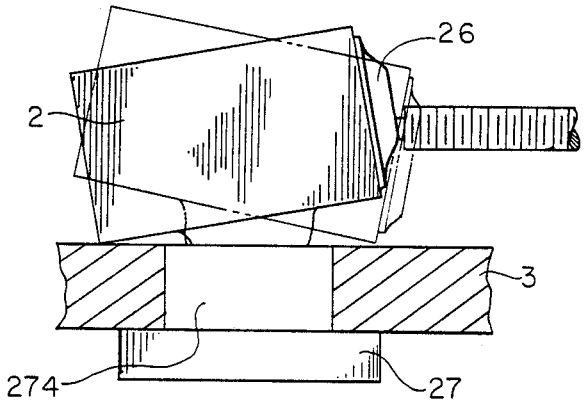
FIG. 61 shows the view of the spherical coupling actions of the spherical coupling structure on the bottom of the clamping jaw group in conjunction with the present invention.

As shown in FIGS. 59 and 60, there is the slide jaw structure adjustable in multiple clamping directions; on its back, it has the above-cited the pushing structure of socket seat 25, at central position in the bottom face of the jaw, a semi-spherical body with longitudinal slot protrudes upward and has as an appropriate thickness; at its center, a fill-in and installation hole 271 can be drilled downward from the top face of the jaw; the feature of this design lies in that a press post 273 with a ball head protrudes from fill-in and installation hole 227, and that the threaded end of press post 273 protrudes downward from the longitudinal slot and also penetrates through ring-and-post support -lock of neck base 274 installed on the bottom base of the jaw or over the slot, and then press post 273 is firmly locked by the female screw; inner threads are made on the wall of the fill-up and installation hole 271 of the slide jaw to accommodate filling block 272 for locking in and filling up the jaw top to a flat level; the coupling face of the above-cited neck base 274 and the spherical body of the jaw bottom face is a spherical concave seat; the bottom of the above-cited fill-in and installation hole 271 has an arc face with a center same to that of the spherical body, and a longitudinal slot is cut and provided on this arc face; socket seat 25 of the jaw back has a concave spherical arc whose radius is larger than the external radius of the terminal sphere of the guide screw; thus, the slide jaw of this invention can, by the socket seat 25 on its back, drive the plane to rotate a small angle and can also make the slide jaw swing up and down to change the angle of elevation as shown in FIG. 61, to maintain the driving status of the guide screw along a straight line and also to make clamping jaw 2 automatically adjust its direction in order to easily clamp a work piece.

Figure 62:
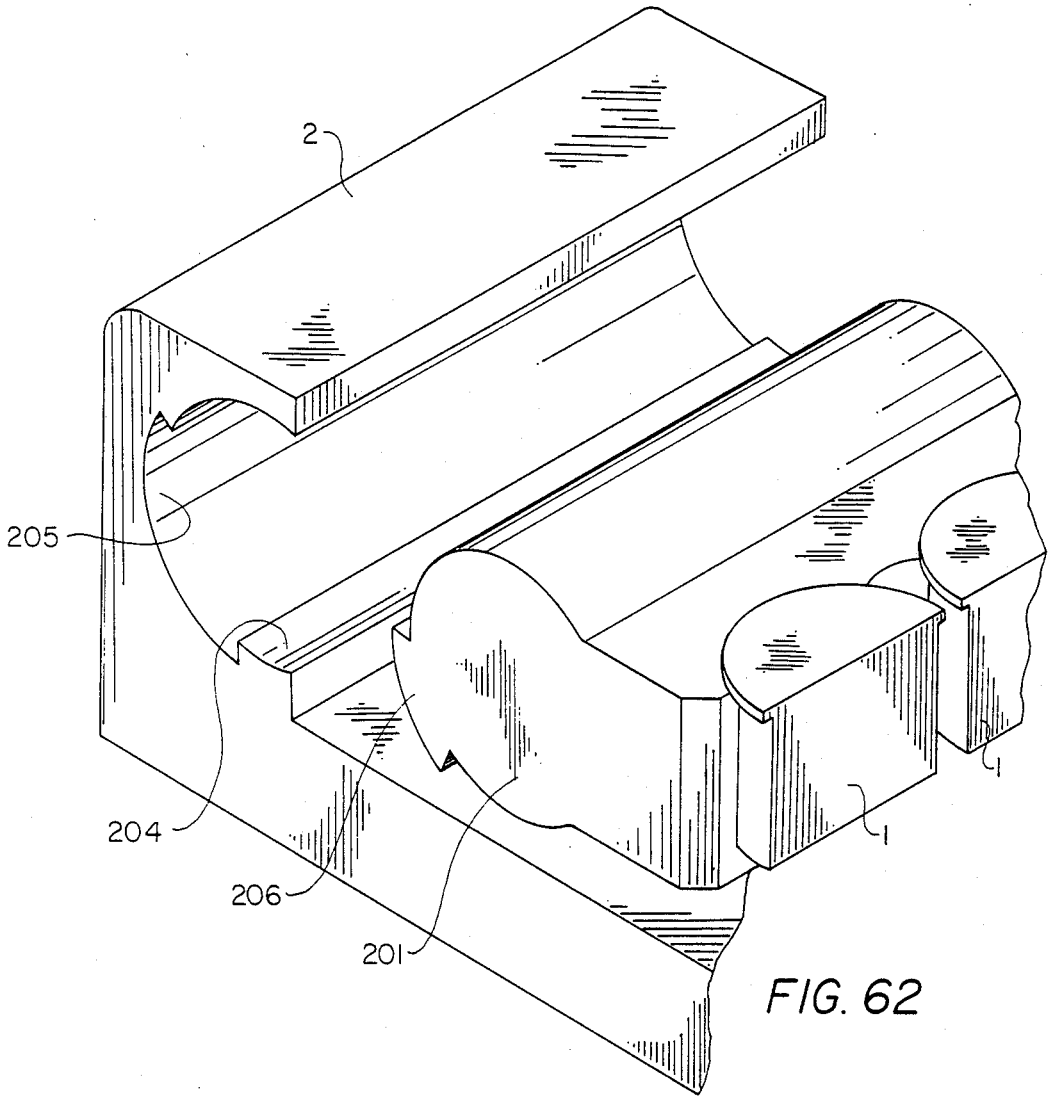
FIG. 62 shows the three-dimensional view of the slide seat of the clamping jaw group which can slide sideway and swing up and down in conjunction with the present invention.
Figure 63:
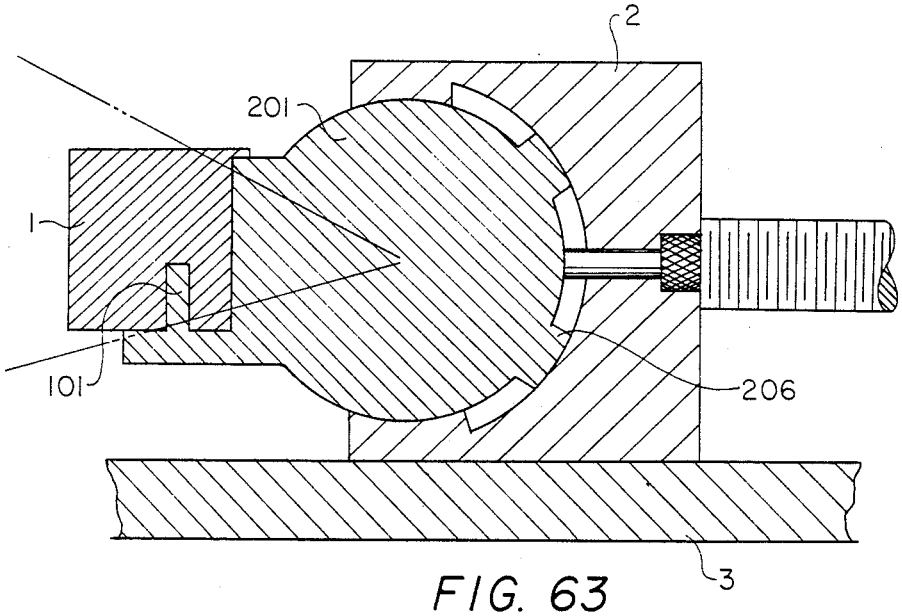
FIG. 63 shows the cross sectional view of the slide seat of the clamping jaw group which can slide sideway and swing up and down in conjunction with the present invention.

The slide jaw of the above-cited jaw group can be in a multi-directional clamping design, or a slide jaw or fixed jaw with a latitudinal arc slot 204 in a horizontal axially fixed radius as shown in FIGS. 62 and 63; a wider latitudinal dove-tail slot 205 is provided on the arc slide wall face of latitudinal arc slot 204; as the arc of the cross section of latitudinal arc slot 204 is larger than 180°, the opposite slide seat 201 with an arc of its cross section same of that of latitudinal arc slot 204 can be installed in this latitudinal arc slot 204, and the front end (i.e. the clamping side) of slide seat 201 protrudes a protruding structure in an arc smaller than 180° for installing movable clamping claw 1; the opening part of latitudinal arc slot 204 or the round arc seat part of slide seat 201 in this design will not slip off; on the slide face of the said round arc, a dove-tail key 206 narrower in width can be provided, so this dove-tail key 206 can slide up and down in the wider sideway dovetail slot 205, thus limiting the allowable angle of elevation of slide seat 201.

Figure 64:
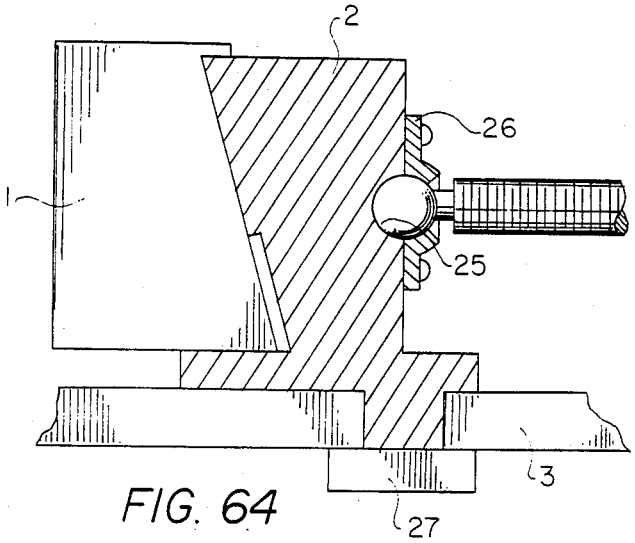
FIG. 64 shows the cross sectional view of the inner concave face provided on the lower side of the slide plane (with an angular locking) of the clamping jaw group in conjunction with the present invention.
Figure 65:
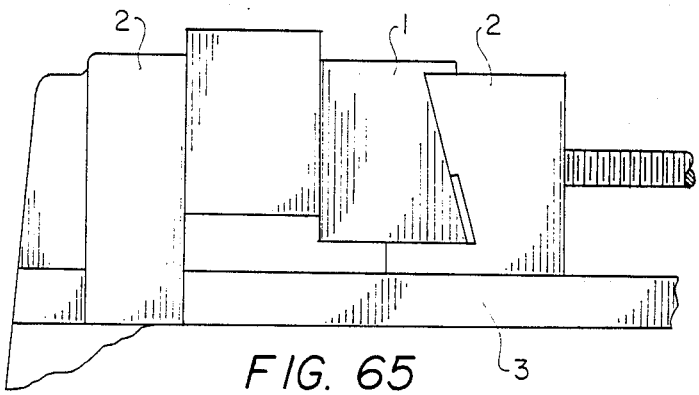
FIG. 65 shows the view of the clamping of the work piece by the inner concave face provided on the lower side of the slide plane to strengthen the angular locking function of the angular locking of the clamping jaw group in conjunction with the present invention.

Furthermore, when clamping jaw group 2 of the present invention is installed with slide seat 201 or movable clamping claw 1, the under side of its oblique slide face can be provided with a concave form in a proper depth along the inverse clamping side as shown in FIGS. 64 and 65; during clamping a work piece, this makes the bottom of slide seat 201 or movable claw 1 tend to move out further, thus intensifying the tightly clamping force of the upper part against the work piece, and forming much better firmly locking effects.

Figure 66:
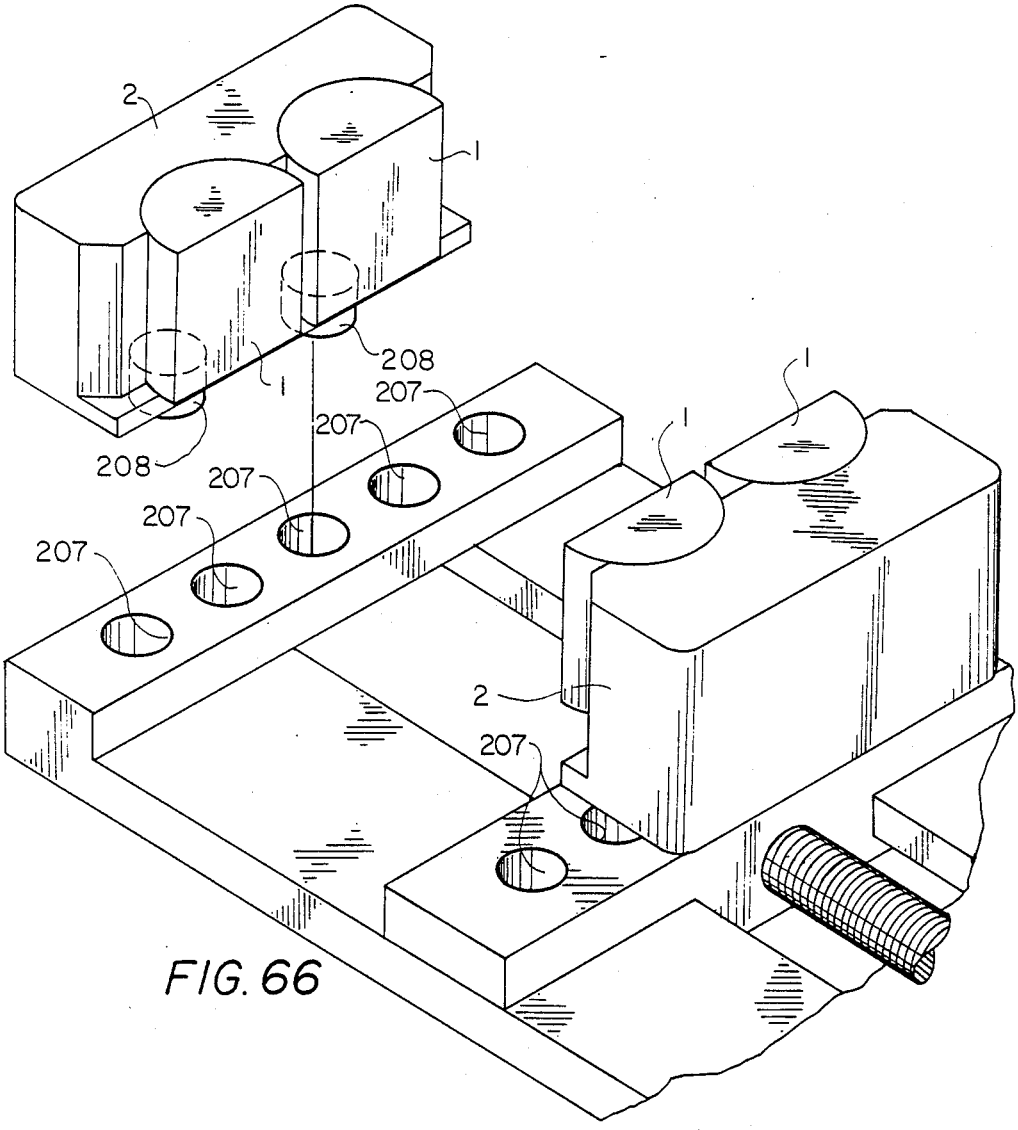
FIG. 66 shows the three-dimensional parts exploded view of the jaw seat and the changeable clamping jaw in conjunction with the present invention.
Figure 67:
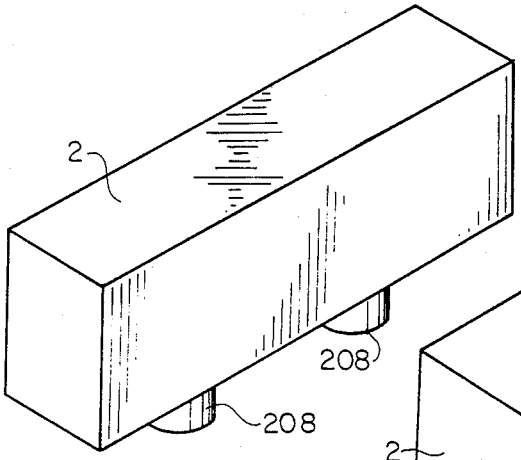
FIG. 67 shows the three-dimensional view 1 of the changeable clamping jaw without the removable clamping claw in conjunction with the present invention.
Figure 68:
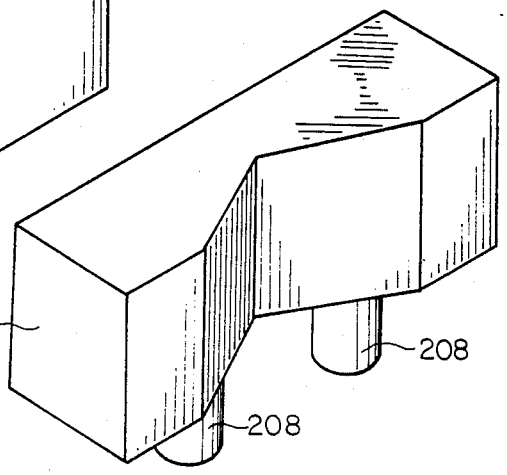
FIG. 68 shows the three-dimensional view 2 of the changeable claping claw in conjunction with the present invention.
Figure 69:
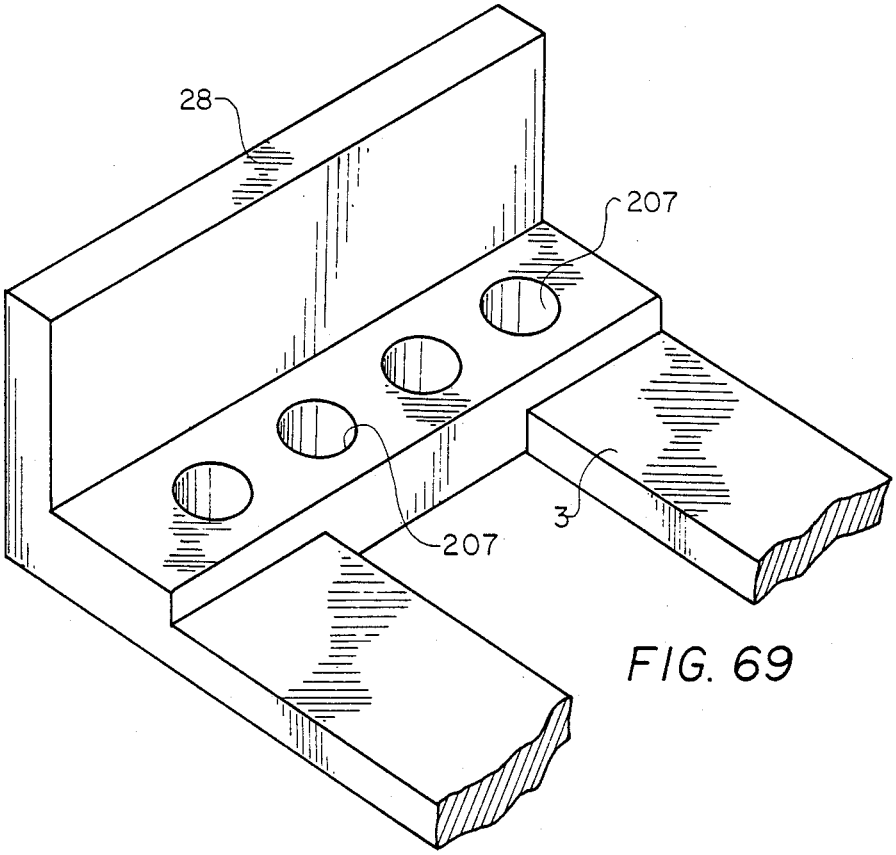
FIG. 69 shows the three-dimensional view of the jaw base seat with support walls in conjunction with the present invention.
Figure 70:
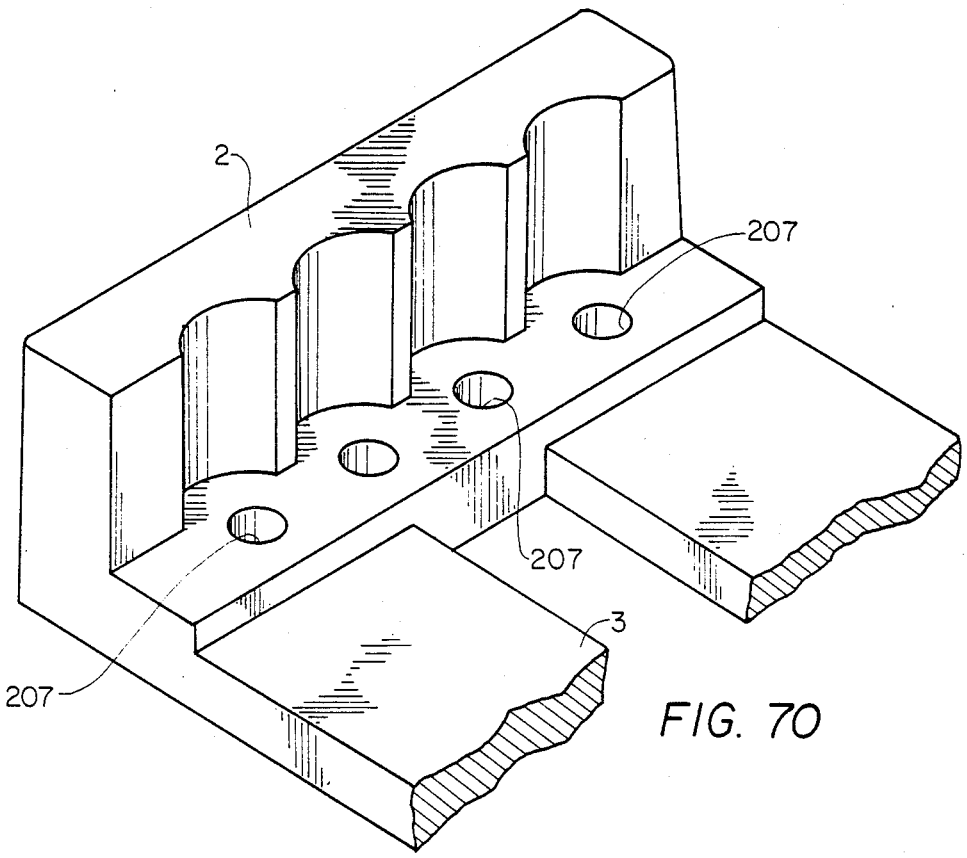
FIG. 70 shows the three-dimensional view of the support walls formed connection of several arcs of the jaw base seat in conjunction the present invention.
Figure 71:
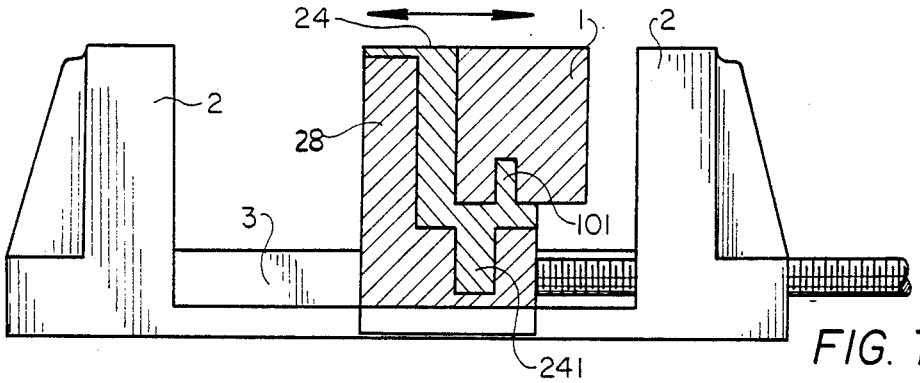
FIG. 71 shows the side view of the two-end fixed jaw and middle slide jaw in conjunction with the present invention.
Figure 72:
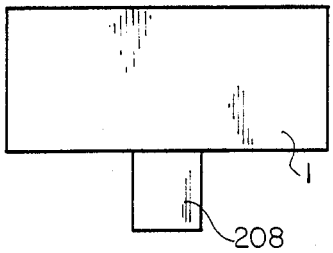
FIG. 72 shows the front view of the movable clamping claw to be directly plugged in the jaw base seat by its plug rod in conjunction with the present invention.
Figure 73:
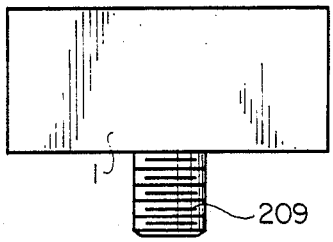
FIG. 73 shows the front view of the movable clamping claw to be directly plugged in the jaw base seat by its bolt in conjunction with the present invention.
Figure 74:
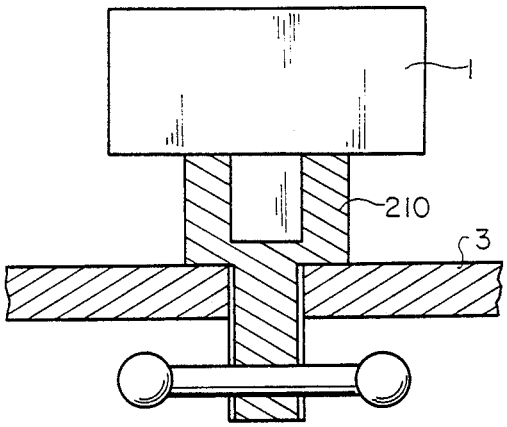
FIG. 74 shows the view of the installation of the movable clamping claw by adjusting the plug socket in conjunction with the present invention.
Figure 75:
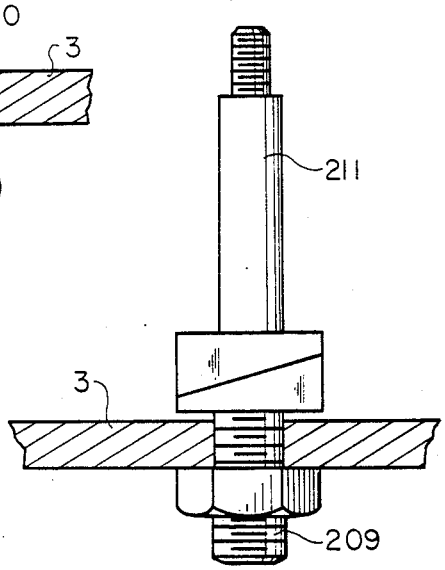
FIG. 75 shows the view of adjusting the plug socket to rotate and plug in the movable clamping claw in conjunction with the present invention.
Figure 76:
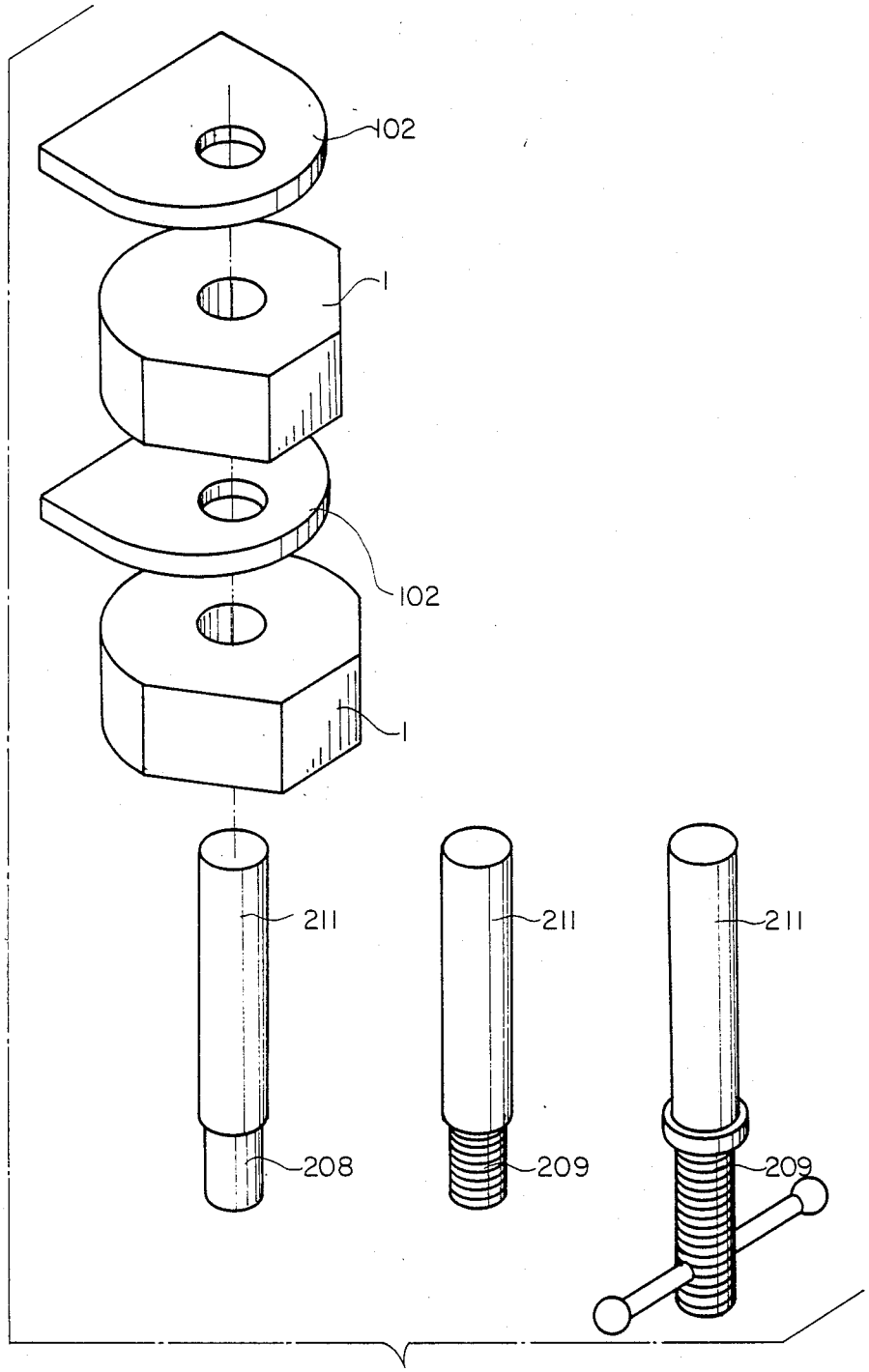
FIG. 76 shows the three-dimensional parts exploded view of the bolt which can penetrate through the multi-layer movable clamping claw in conjunction with the present invention.

The servo-clamping device in the present invention can be, according to the actual needs, designed into changeable clamping group 2; as shown in FIG. 66, it can be in a form that plug holes 207 are provided at equal distances between them on the bearing face of the base seat of the jaw, while its clamping jaw 2 is a separate body in a thickness same to that of the base seat of the jaw, and on the bottom of clamping jaw group 2, plug rods 208 are provided and can be selectively plugged into such equal-distant plug holes 207 to become in a readiness status; after plug rod 208 is plugged in, clamping jaw group 2 can be tightly locked up by bolts at the place under the bearing face of the base seat of the jaw. As shown in FIGS. 66 and 68, clamping side of the above-cited separate clamping jaw group 2 can be provided with the above-said various kinds of movable clamping jaws 1, or such separate clamping jaw group 2 do not have any movable clamping jaws 1 at all; the structure of the base seat of the jaws can also have support walls 28; as shown in FIG. 69, the plane support wall 28 can be provided with shorter independent jaws as desired; the bearing face of such support walls 28 can be formed by a formation of several concave arcs in connection; at the center of each concave arc, a plug hole 207 is provided for the insertion and positioning of separate rotary seats 24 and movable clamping claws 1; or as shown in FIGS. 72, 73, 74, and 75, from the center of each of movable clamping claws 1, a plug rod 208 or bolt 209 protrudes downward to be inserted or locked in plug holes 207; or middle adjustment rods 210 which can adjust the positions of height are inserted into plug holes 207; each of such middle adjustment rods may have a plug socket on its upper part and its lower part can plug or screw into holes 207 of the bearing face of the jaws; or their bottom part can be connected with bolt 209 or plug rod 208, while their upper part is coupled by an oblique penetration post 211, thus forming a structure of the penetration post 211 rotatable as desired. This penetration post 211 can penetrate and be installed with a single-layer or multi-layer movable clamping claws 1 as shown in FIGS. 75 and 76; the movable clamping claws 1 of this design can directly use the support wall 28 as their bearing force face, and can be, directly by the penetration, installation and locking of the penetration post 211, locked to plug hole 207 on the base seat of the jaw 1 of which if penetration post 211 or plug rod 208, bolt 209, or middle adjustment rod 210 additionally added and tightly locked with a positioning piece, after penetration post 211 or plug rod 208, bolt 209 or middle adjustment rod 210 has penetrated through the base seat of the jaw, the movable clamping claws 1 can be provided on the part of the fixed jaw to get rid of interfering the sliding movements and also to expedite the adjustments of their heights from the bottom.

Figure 77:
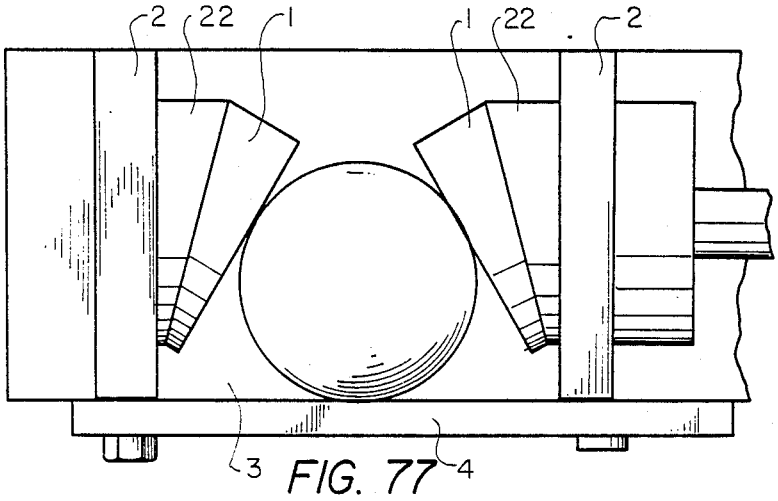
FIG. 77 shows the top view of the clamping of a ball work piece by the auxiliary blocking block in conjunction with the present invention.
Figure 78:
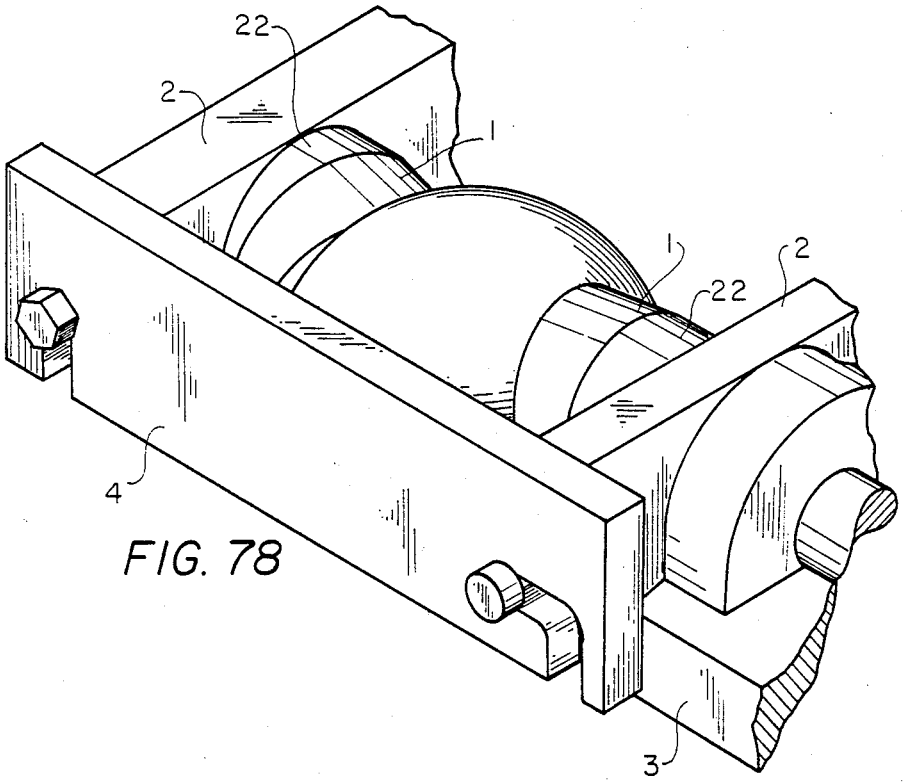
FIG. 78 shows the three-dimensional view of the clamping of a ball work piece by the auxiliary blocking block in conjunction with the present invention.

As shown in FIGS. 77 and 78, this invention can also clamp work pieces in special shapes by the auxiliary blocking block 4 which is positioned on the side of the slide jaw and can also be turned and engaged with the fixed jaw or which is positioned on the side of base seat 3; this makes the work piece positioned by the three-point clamping claws, thus the work piece will not slip off sideways along the pressing direction of movable clamping claws 1 due to the particular shape of the work piece; as shown in FIG. 78, auxiliary blocking block 4 may have an engagement opening to accommodate the fixed jaw and base seat 3 to block the work piece.

Figure 79:
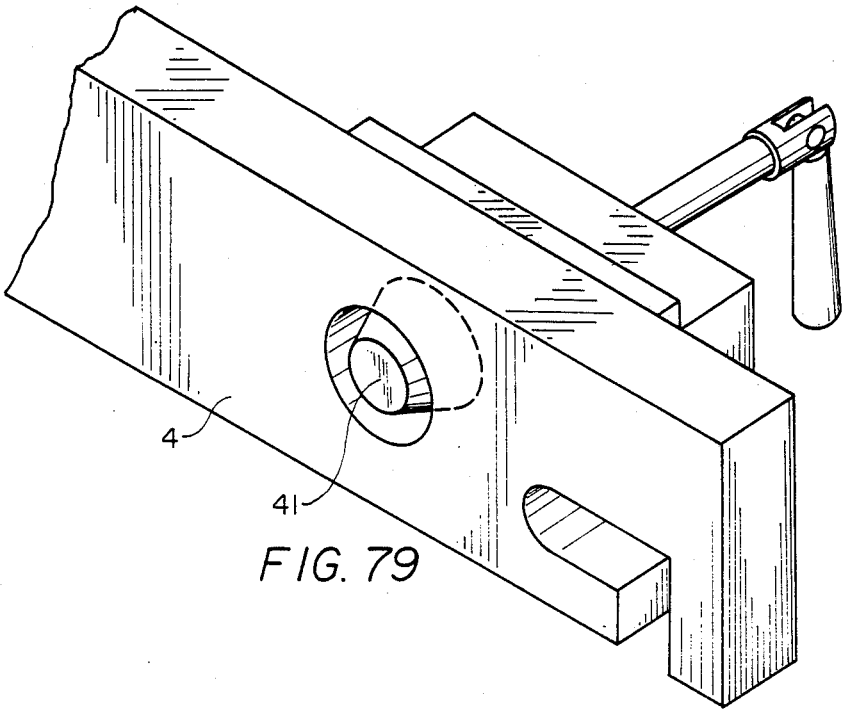
FIG. 79 shows the three-dimensional view of the small blocking block and its driving structure additionally provided on the blocking block in conjunction with the present invention.
Figure 80:
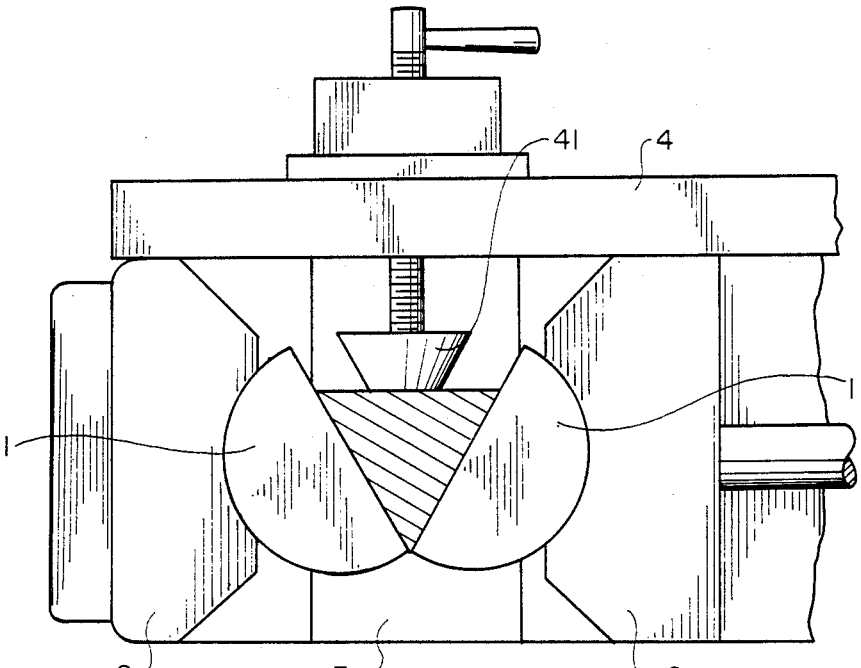
FIG. 80 shows the view of the clamping of the work piece by the small blocking block on the blocking block in conjunction with the present invention.

The auxiliary blocking block 4 of the above-cited design can also have drivable small blocking blocks 41 as shown in FIGS. 79 and 80, of which these small blocking blocks 41 can be fixed or movable clamping claws 1 in various proper shapes, a bolt-driving structure can stretch out from or retract into the auxiliary blocking block 4, thus making small blocking blocks 41 and auxiliary blocking block 4 form a plane. The driving structure of small blocking blocks 41 of this design can be the same as shown in the drawing that a driving seat is fixedly provided on the external side of auxiliary blocking block 4 to accommodate the penetration and installation of bolts, the end of the bolts is driven by the conventionally used handle, or an electrically power operated driving structure is provided on the driving seat to make small blocking blocks 41 extend a set proper length.

Figure 81:
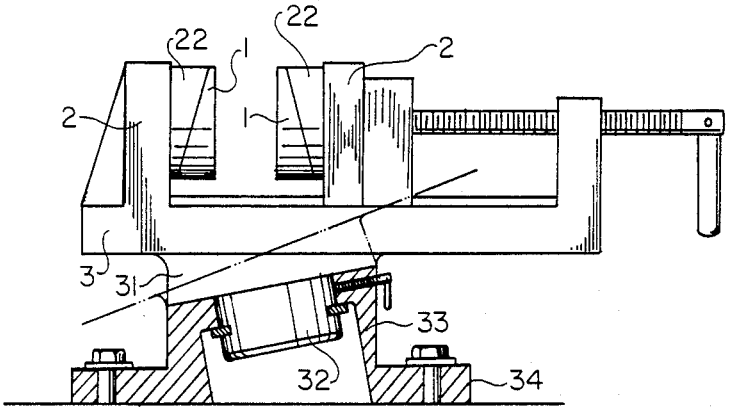
FIG. 81 shows the top view of the clamping device as positioned on the movable base seat in conjunction with the present invention.
Figure 82:
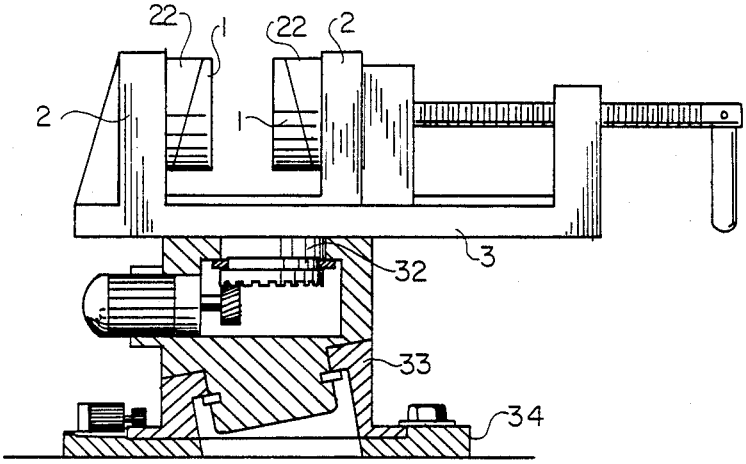
FIG. 82 shows the view of the clamping device as positioned on the electrical-power-driven base seat in conjunction with the present invention.

The base seat 3 of the present invention serves a table for the sliding and positioning of integral clamping jaw group 2, and can be a seat body which extends downward and directly from the center of gravity of clamping jaw group 2 and can be firmly locked on or horizontally laid on other work table as shown in FIGS. 1, 44, 45, 47, 48, 49, 60 and 70; this base seat 3 can match the slide bearing face, jaw base seat or drilled holes provided on the fixed jaw, slide jaw or changeable clamping jaw of clamping jaw group 2; or as shown in FIGS. 81 and 82, a mechanical post 31 extends downward from the position of the center of gravity of clamping jaw group 2, the end face on the bottom of this mechanical post 31 is an oblique plane; a positioning post 32 extends from the center of this oblique plane, to plug in table seat 33 of an oblique end face, of which table seat 33 is formed by the upward extention of fixed seat 34; after inserted in table seat 33, the positioning post 32 of this design can be positioned by a press spring or press pin, while fixed seat 34 can be locked on the work table by fixing screws; thus clamping jaw group 2 can be rotated along the oblique coupling face between mechanical post 31 and table seat 33 to adjust the azimuth and clamping direction of the work pieces under clamping as desired.

The design of the above-cited base seat 3 which can adjust the position of clamping jaw group 2 can also make base seat 3 have a multi-step mechanical post 32 to couple and connect oblique planes or horizontal planes to serve a design of multi-step adjustments, whereas the rotary and rotational adjustments of various steps can be made by the joint-motion structure of other machineries such as gear drive, in addition to manual power or electrical power driven means to conduct fixed or unfixed rotational as shown in FIG. 82.

Figure 83:
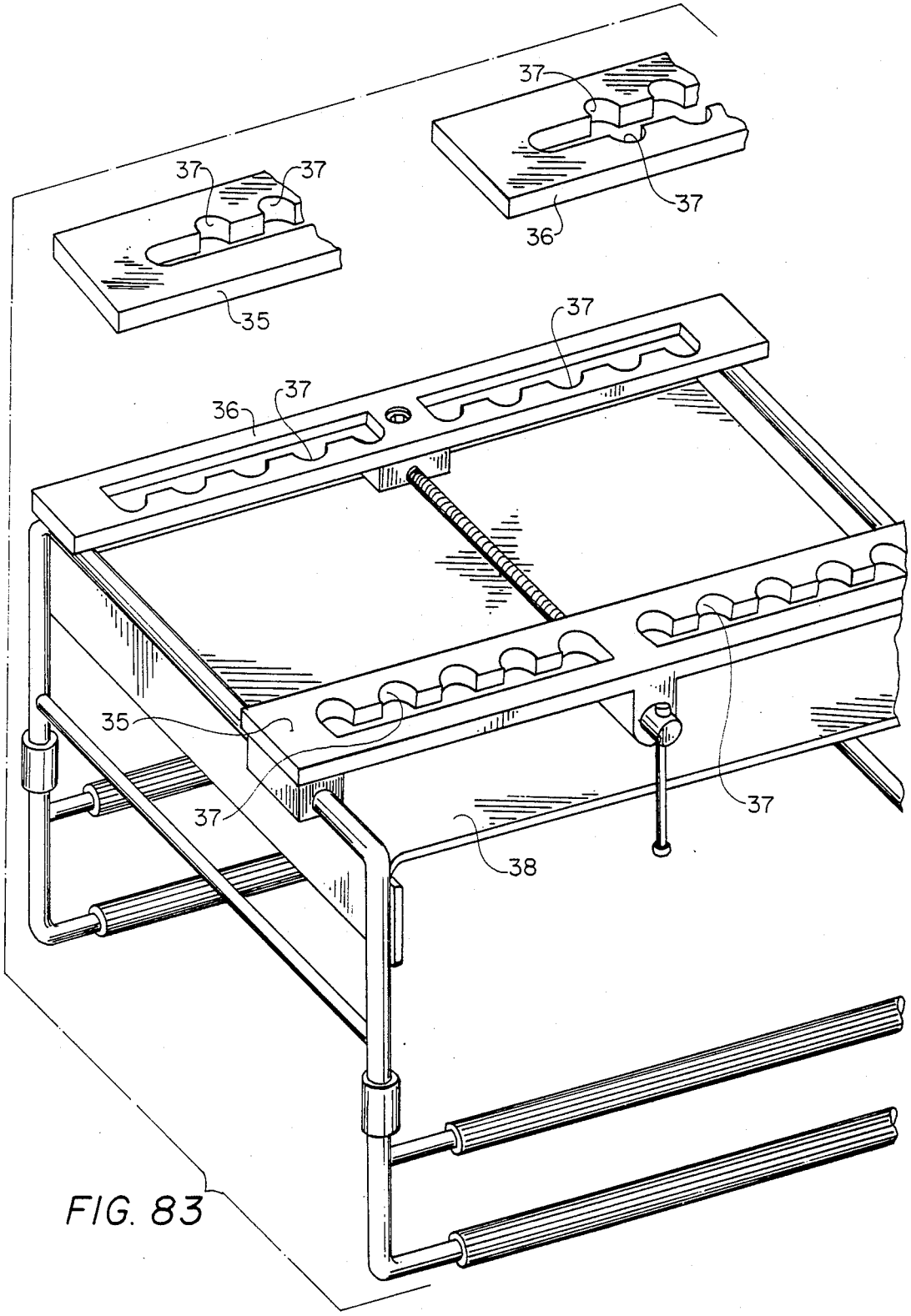
FIG. 83 shows the three-dimensional view of the work-bench-type base seat to be firmly fixed on the floor in conjunction with the present invention.
Figures 1, 83:
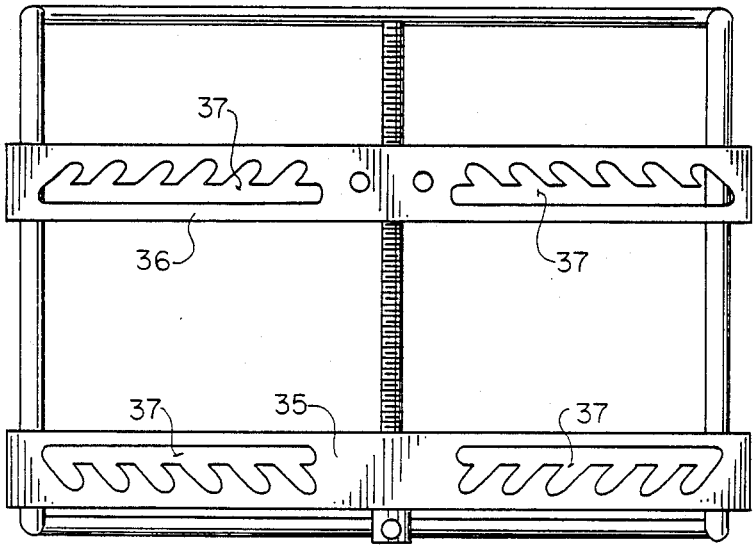
Figures 2, 83:
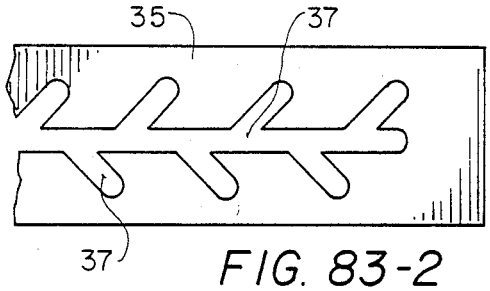
Figures 3, 83:
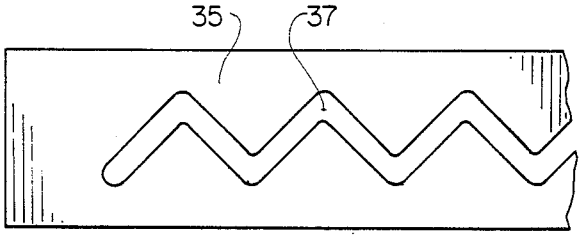
Figures 8, 83:
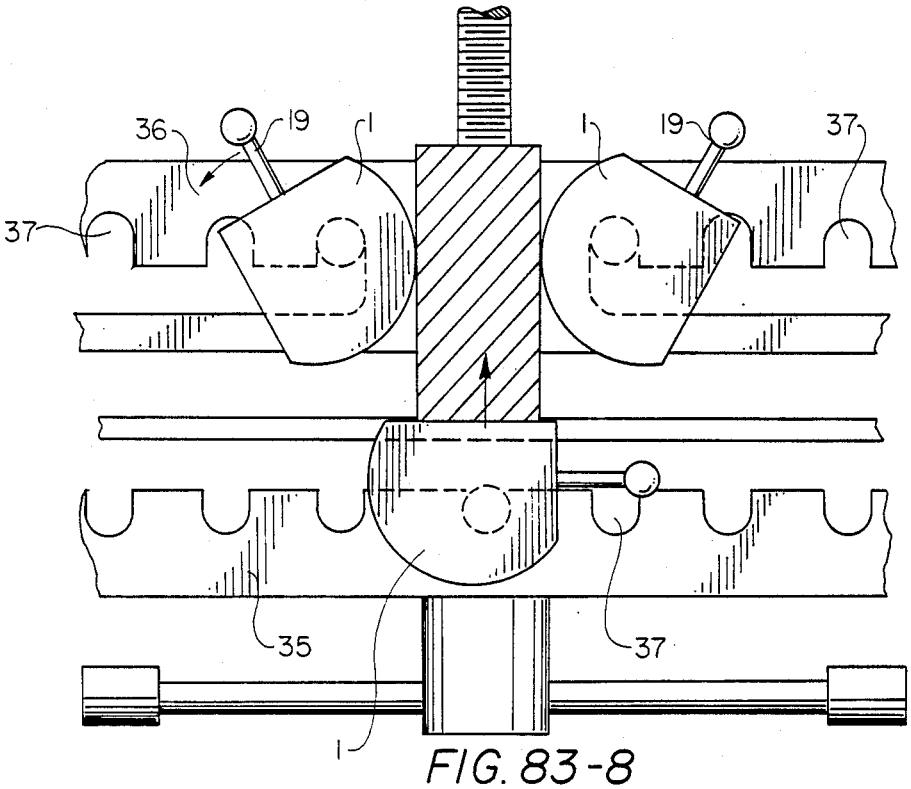
Figures 4, 83:
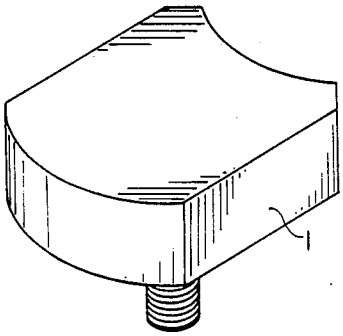
Figures 5, 83:
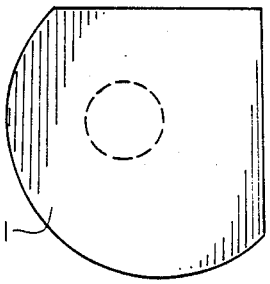
Figures 7, 83:
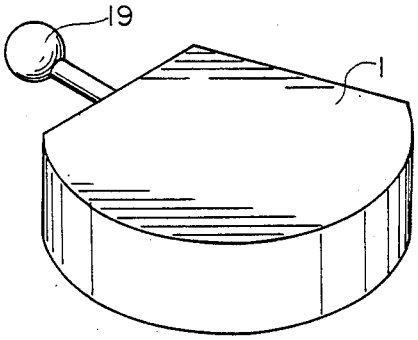
Figures 6, 83:
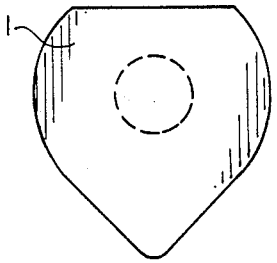
Figures 10, 83:
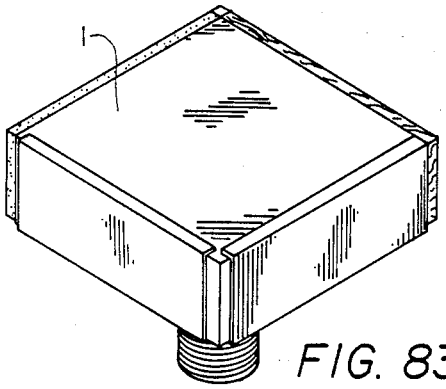
Figures 9, 83:
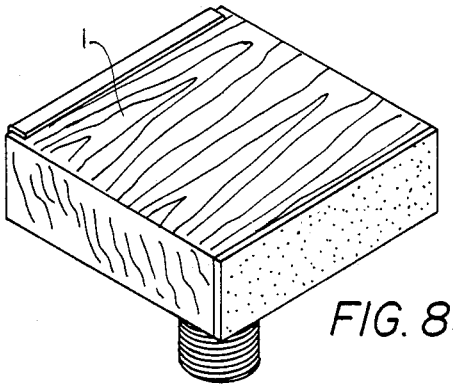
Figure 84:
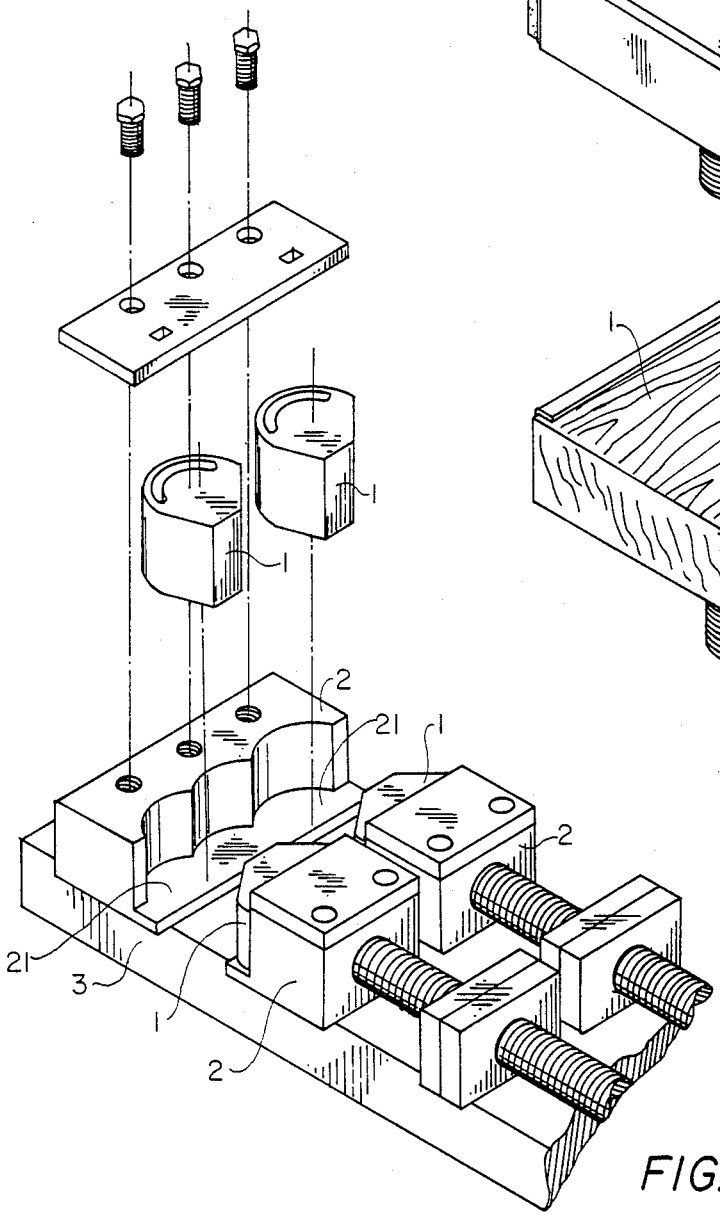
FIG. 84 shows the three-dimensional view of the clamping jaw group, one side of which is multi-group and separately driven in conjunction with the present invention.

The base seat of the servo-clamping device under the present invention can also be firmly installed on the work table (bench) on the floor as shown in FIG. 83, this work table (bench) has a sleeve-on and retractable rod-frame structure, on the top face of the work table (bench), positioning seat 35 and positioning slide seat 36 are provided along the rod-frame, of which positioning seat 25 is horizontally laid on the rod-frame, while positioning slide seat 36 positions with the holding rod frame of the penetration and installation seats on its sides; positioning seat 35 and positioning slide seat 36 are coupled by guide screw and can be driven in opposite directions; positioning seat 35 and positioning slide seat 36 under this design can serve as the base seat of the jaw of clamping jaw group 2, on which opposite latitudinal slots are provided respectively; on such slots, semi-circular connection holes 37 are cut and provided at equal intervals, and in opposite inward or outward or inward of outward directions; such semi-circular connection holes 37 can be used by the movable clamping claws 1 of changeable clamping jaw or separate body of clamping jaw group 2 to make the applications of the present invention to clamp work pieces even more flexible. Besides, at the lower side of the above-cited positioning seat 35 and positioning slide seat 36, an article-carrying tray 38 is firmly provided by the rod-frame structure; the position to firmly set up this article-carrying tray 38 is slightly lower than that of the fixed seat of the guide screw to avoid any interference with the driving actions of the guide screw; the main functions of this article-carrying tray is to temporarily set related tools on this tray, when clamping jaw groups 2, movable clamping claws 1 or work pieces.

Figure 2:
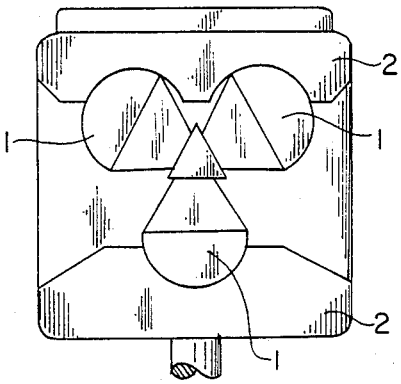
FIG. 2 shows the view of three movable clamping claws clamping a small triangular work piece of the exemplary example in FIG. 1.
Figure 3:
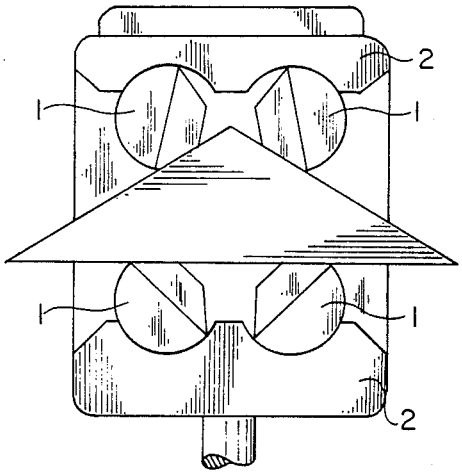
FIG. 3 shows the view of four movable clamping claws clamping a big triangular work piece of the exemplary example in FIG. 1.

As shown in FIG. 83-1, outwardly faced connection holes 37 which are inclining inward in their central part are provided on the positioning seat 35 and positioning slide seat 36, such inwardly inclining connection holes 37 make movable clamping claws 1 only eccentrically displace toward the center during their clamping of a work piece and sliding, thus clamping the work piece lighter; if the connection holes 37 are made to incline toward both external sides, when movable clamping claws 1 tightly clamp the work piece, movable clamping claws 1 can only move toward the center, thus tending to exercise pressures toward the center, as shown in FIGS. 83-2 and 83-3, they can have connection holes 37 toward inside and outside which may be provided in an oblique shape and at fixed positions in branch-shaped fork or wave-shaped or pinacle and valley-shaped formation.

Figure 4:
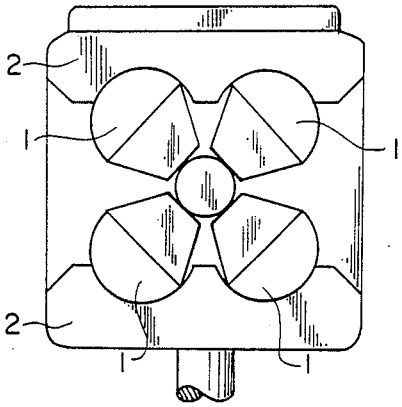
FIG. 4 shows the view of four movable clamping claws clamping a small cylindrical work piece of the exemplary example in FIG. 1.
Figure 5:
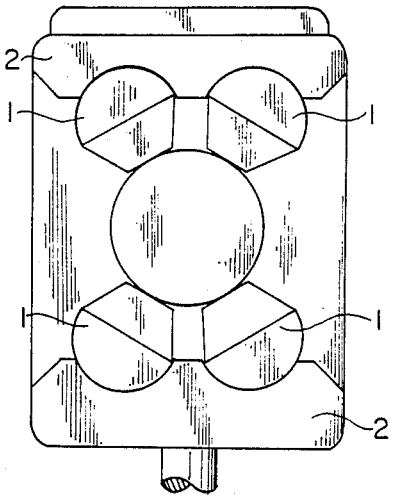
FIG. 5 shows the view of four movable clamping claws clamping a big round work piece of the exemplary example in FIG. 1.
Figure 6:
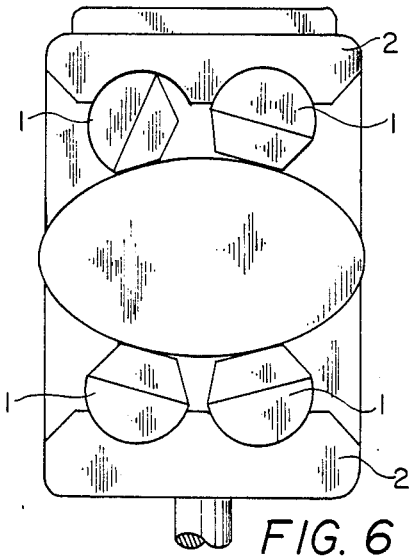
FIG. 6 shows the view of four movable clamping claws clamping a big elliptic work piece of the exemplary example in FIG. 1.
Figure 7:
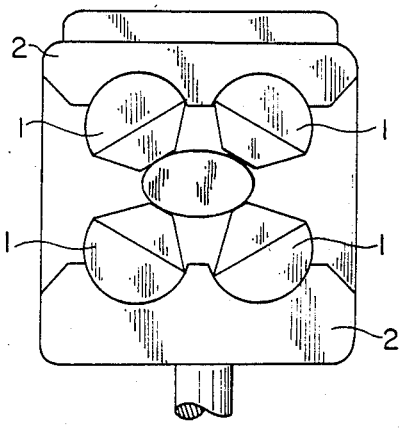
FIG. 7 shows the view of four movable clamping claws clamping a small elliptic work piece of the exemplary example in FIG. 1.
Figure 8:
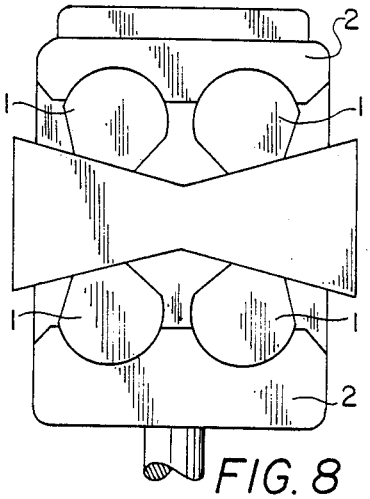
FIG. 8 shows the view of four movable clamping claws clamping an irregular multi-lateral work piece of the exemplary example in FIG. 1.

When the design of this invention is used to the movable clamping claws 1 on the work table (bench) on the floor can be separately inserted and positioned in connection holes 37, as shown in FIG. 83-4, such movable clamping claws 1 have the clamping sides of the plane and concave and convex arc face, or as shown in FIGS. 83-5 and 83-6, they have eccentric plug rod 208 or bolt 209, their eccentric arc clamping side can be unidirectional or two-directional two-sided formation as shown in FIG. 83-6, they also can have push handle 19 provided at a proper position on movable clamping claws 1 to push movable clamping claws 1, as shown in FIGS. 83-7 and 83-8, when movable clamping claws 1 are clamping a work piece, and after the eccentric movable claws 1 are rotated by the push handle, two opposite clamping faces produce the status of distance reduction, thus clamping the work piece tighter; if the movable clamping claw 1 on the other side pushes the work piece again, the frictional action between the work piece and the movable clamping claws 1 makes movable clamping claws 1 produce rotations to clamp the work piece tighter.

Figure 9:
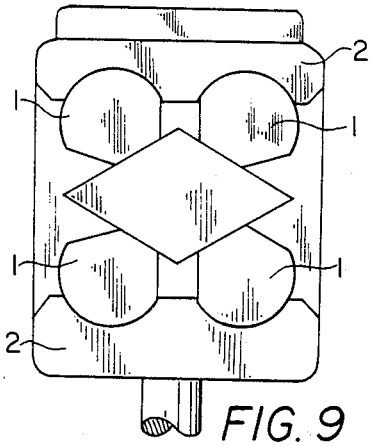
FIG. 9 shows the view of four movable clamping claws clamping a diamond-shaped work piece of the exemplary example in FIG. 1.
Figure 10:
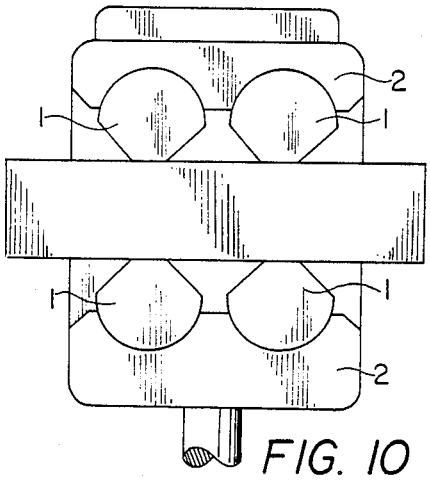
FIG. 10 shows the view of four movable clamping claws clamping a parallel work piece of the exemplary example in FIG. 1.
Figure 12:
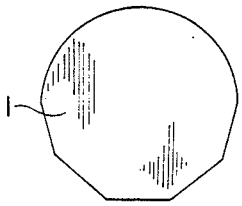
FIG. 12 shows the top view of the multi-lateral convex clamping surface of the clamping claw of the exemplary example in conjunction with the present invention.
Figure 13:
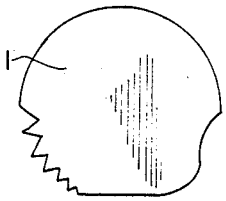
FIG. 13 shows the top view of the plane and convex and concave teeth of the convex clamping surface of the movable clamping claw of the exemplary example in conjunction with the present invention.
Figure 11:
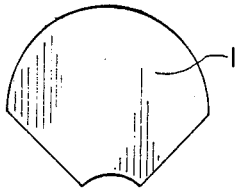
FIG. 11 shows the top view of the concave arc of the convex clamping surface of the clamping claw of the exemplary example in conjunction with the present invention.
Figure 14:
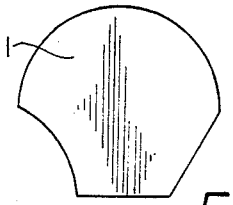
FIG. 14 shows the top view of the plane and convex arc of the convex clamping surface of the clamping claw of the examplary example in conjunction with the present invention.

The servo-clamping device of the above-cited design can be also used to wood working, whereas in addition to the above-cited forms, its movable clamping claws 1 can be made with wooden materials and their clamping sides can be firmly glued with rubber plate or metal clamping jaw as shown in FIG. 83-9, or can be made with metal materials on which then clamping faces in various forms maybe installed as shown in FIG. 83-10.

Summing up all the above-cited various applicable structures, the servo-clamping device under the present invention, can, according to the characteristics of work pieces at the processing sites, make various clamping jaw groups 2 have a single group or several groups of movable clamping claws as shown in FIG. 1 to 10, 33 to 49, 52, 53, 84 and 85, and also make movable clamping claws 1 on two sides installed and positioned in staggered positions with counterparts on the opposite sides; this makes movable clamping claws 1 directly clamp a work pieces, or makes compensatory trapezoidal lateral side face clamp smaller and thinner work pieces.

Figure 86:
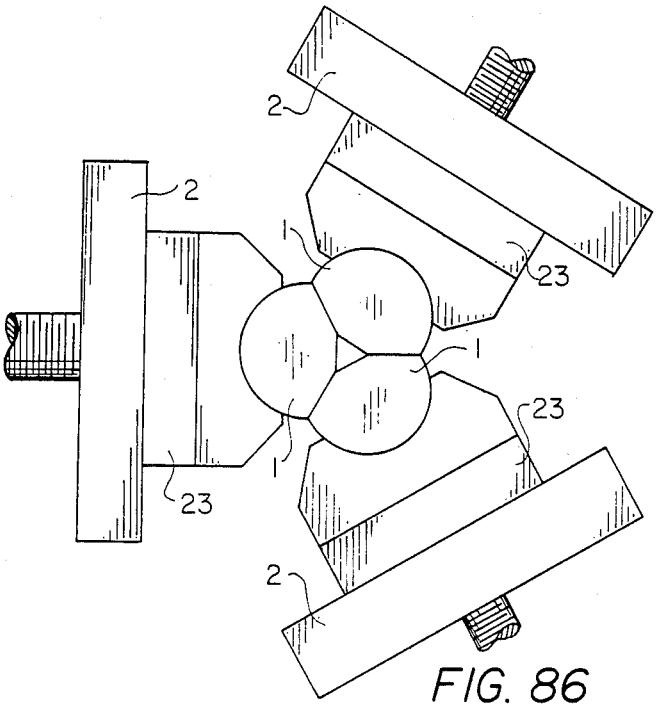
FIG. 86 shows the top view of three groups of the movable clamping claws with the intersection of their driving loci at one point in conjunction with the present invention.
Figure 87:
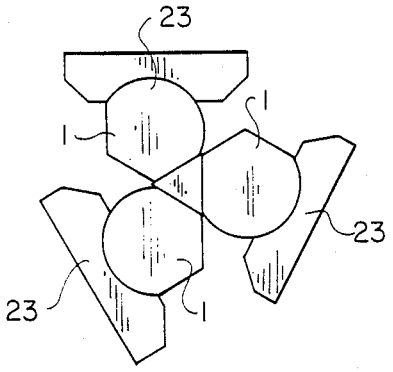
FIG. 87 shows the top view of three groups of the movable clamping claws with the intersection of their driving loci at one point and of the clamping of a work piece by their auxiliary sides in conjunction with the present invention.
Figure 88:
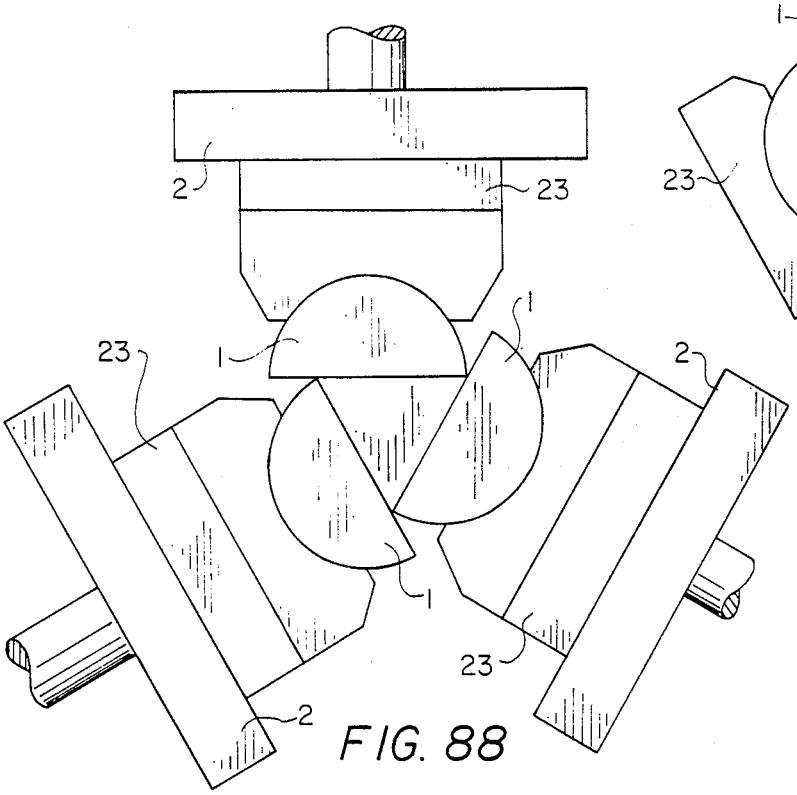
FIG. 88 shows the top view of three groups of the movable clamping claws, when their driving loci form of a triangle in conjunction with the present invention.
Figure 89:
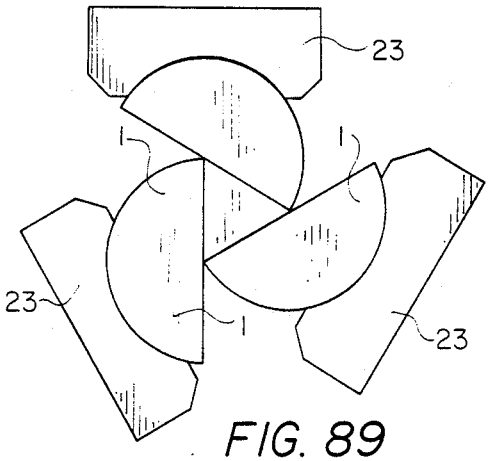
FIG. 89 shows the top view of clamping a very small work piece by rotations of the movable clamping claws, when the driving loci of three groups of the movable clamping claws form a triangle in conjunction with the present invention.
Figure 92:
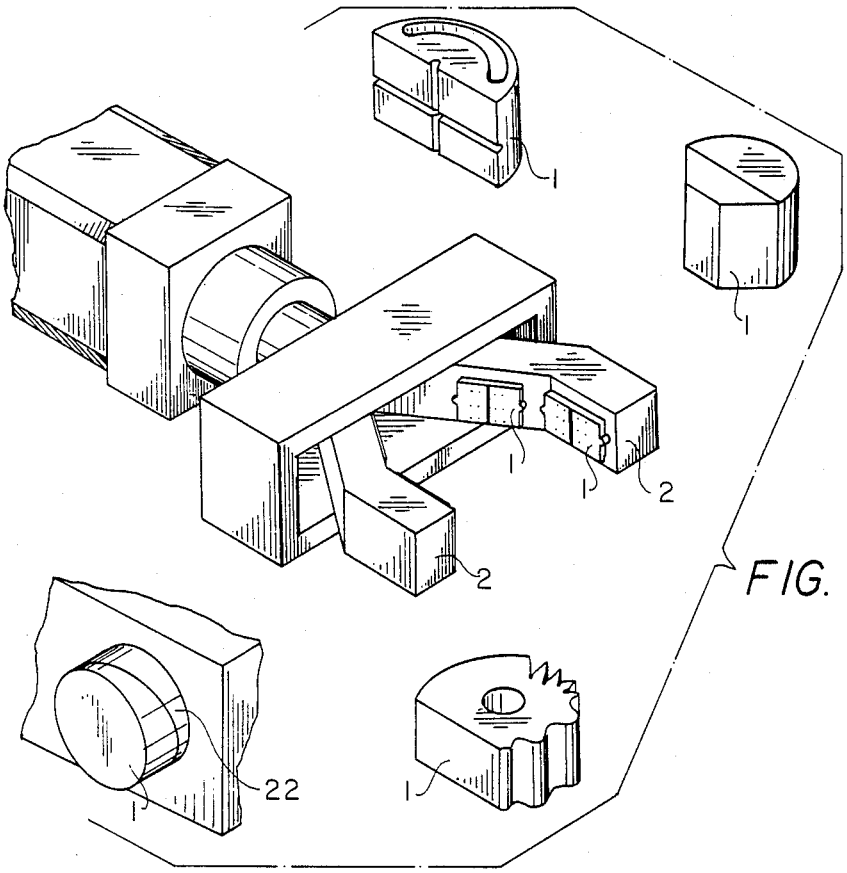
FIG. 92 shows the three-dimensional view of the clamping structure as installed on the mechanical arm in conjunction with the present invention.

The clamping jaw group 2 under the present invention can also, according to the work characteristics, be installed in more directions and more groups; as shown in FIG. 86, clamping jaw group 2 is a form of triangular positioning according to base seat 3, by which the guide screw pushes and holds clamping jaw group 2 in three directions to clamp a work piece toward the center; the formation of its triangular position can make these three driving directions concentrate at one point, thus also making movable clamping claw 1 with compensatory trapezoidal clamping face being fully capable of clamping very small triangular and round work pieces or work pieces in other shapes, while those which can clamp larger work pieces by their semi-cylindrical movable clamping claw 1 are shown in FIG. 88. The way of the installation of triangular positions to clamp clamping jaw group 2 under this design can also make the driving loci of three groups of clamping jaw group 2 form a triangle in a proper size as shown in FIGS. 87 and 89, and, at the same time, the compensatory clamping face of movable clamping claw 1 may rotate a certain angle to achieve the purpose of reducing the clamping area.

Figure 85:
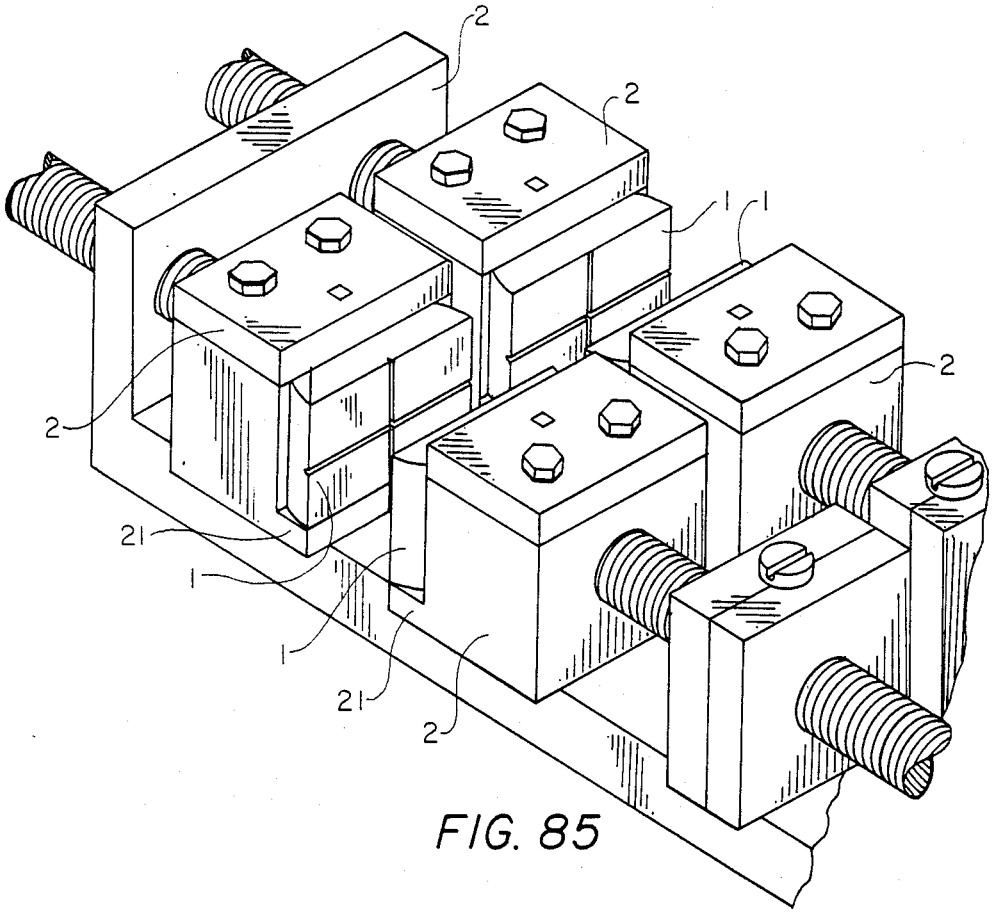
FIG. 85 shows the three-dimensional view of the clamping jaw group, two sides of which are multi-group and separately driven in conjunction with the present invention.
Figure 90:
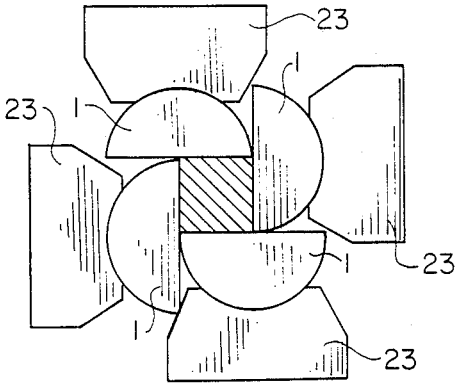
FIG. 90 shows the top view of four groups of the movable clamping claws, when their driving loci form a rectangle in conjunction with the present invention.
Figure 91:
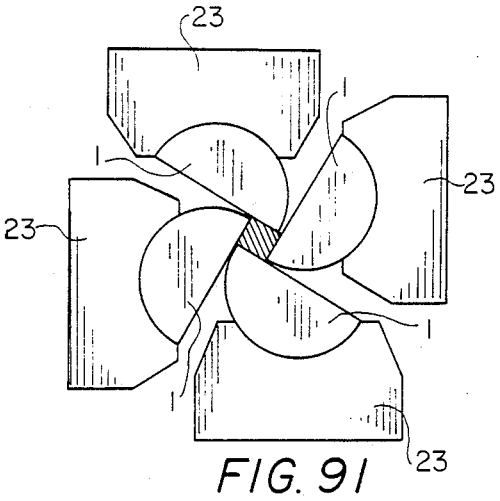
FIG. 91 shows the top view of clamping a very small work piece by rotations of the movable clamping claws, when the driving loci of four groups of the movable clamping claw form a rectangle in conjunction with the present invention.

The design of the above-cited driving loci can be expanded to install separate four-point or multi-point, equilateral or unequilateral clamping jaw groups, as shown in FIG. 85 is a four-point unequilateral separate clamping jaw group 2; as shown in FIGS. 90 and 91 are installed in equilateral form, but its driving loci form a properly sized square; if this structure has its movable clamping claws 1 in a semi-cylindrical form, under contition of normal positions, its movable clamping claws 1 can clamp a square in a size similar to the radius of a movable clamping claw 1 or a cylinder or sphere in an equivalent diameter, and can clamp work pieces in much smaller sizes, after the angle of movable clamping claws 1 is properly adjusted.

The clamping jaw group 2 and movable clamping claw 1 of the servo-clamping device under the present invention can be applicable to conventionally used various clamping devices, or movable mechanical frames, machineries, and arms, and when movable clamping claw 1 clamps a work piece, this device can automatically adjust its angles according to the configuration of the work pieces to naturally form the best tightening status during tightly clamping a work piece.

I claim:

1. In a clamping device, wherein a pair of clamping jaw groups are mounted on a base, wherein one of the clamping jaw groups is movable in a direction towards and away from the other clamping jaw group to clamp a workpiece therebetween, and wherein at least the other of the clamping jaw groups includes a pair of movable clamping jaws arranged laterally of one another, the improvement comprising each movable clamping jaw being multi-layered and including at least a pair of movable clamping claws spaced vertically of one another, the base of the clamping device having an upwardly-extending base member, and means for mounting each movable clamping claw in the multi-layered movable clamping jaw in the other of the clamping jaw groups for pivotal movement on the base, said mounting means including a post extending upwardly from the base of the clamping device, each movable clamping claw having a central hole for receiving the post, each movable clamping claw including a rearward portion having a substantially semi-circular plan outline, the upwardly-extending base member having a pair of vertically-spaced substantially semi-circular channels formed therein for receiving the respective semi-circular rearward portions of the movable clamping claws, respectively, each of the movable clamping claws further having a forward multi-faceted portion including at least a pair of planar clamping faces arranged transversely of one another, and a non-movable supporting ring member interposed between the pair of movable clamping claws, the supporting ring member having a central hole formed therein for receiving the post, the supporting ring member further having a forward portion extending substantially inwardly of the multi-faceted planar faces of the respective movable clamping claws, and the supporting ring member still further having a rearward portion provided with a flat edge for bearing against the upwardly-extending base member between the channels formed therein.

2. The improvement of claim 1, wherein the upwardly-extending base member comprises a slide seat member carried by the base of the clamping device for limited movement thereon transversely of the direction of movement of the one clamping jaw group.

3. The improvement of claim 1, wherein each of the movable clamping claws has a vertical thickness which is substantially greater than the relatively-thin supporting ring member disposed therebetween.

* * * * *